US007802640B2

(12) United States Patent
Gutmark et al.

(10) Patent No.: US 7,802,640 B2
(45) Date of Patent: Sep. 28, 2010

(54) ROTARY DRILL BIT WITH NOZZLES DESIGNED TO ENHANCE HYDRAULIC PERFORMANCE AND DRILLING FLUID EFFICIENCY

(75) Inventors: Ephraim J. Gutmark, Cincinnati, OH (US); Tuck Leong Ho, Fernwood Forest, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 542 days.

(21) Appl. No.: 11/466,252

(22) Filed: Aug. 22, 2006

(65) Prior Publication Data

US 2007/0163811 A1 Jul. 19, 2007

Related U.S. Application Data

(60) Provisional application No. 60/710,452, filed on Aug. 23, 2005.

(51) Int. Cl.
*E21B 10/60* (2006.01)

(52) U.S. Cl. ..... 175/340; 175/393

(58) Field of Classification Search ..... 175/339, 175/340, 393

See application file for complete search history.

(56) References Cited

U.S. PATENT DOCUMENTS

| | | | | |
|---|---|---|---|---|
| 4,516,642 A | | 5/1985 | Childers et al. | 175/340 |
| 4,531,592 A | | 7/1985 | Hayatdavoudi | 175/67 |
| 4,558,754 A | | 12/1985 | Childers et al. | 175/340 |
| 4,582,149 A | | 4/1986 | Slaughter, Jr. | 175/340 |
| 4,611,673 A | | 9/1986 | Childers et al. | 175/340 |
| 4,657,093 A | | 4/1987 | Schumacher | 175/353 |
| 4,776,412 A | | 10/1988 | Thompson | 175/393 |
| 4,784,231 A | | 11/1988 | Higgins | 175/340 |
| 4,794,995 A | * | 1/1989 | Matson et al. | 175/393 |
| 4,972,410 A | | 11/1990 | Cohen et al. | 370/100 |
| 4,989,680 A | | 2/1991 | Deane et al. | 175/340 |
| 5,009,272 A | | 4/1991 | Walter | 175/56 |
| 5,029,656 A | | 7/1991 | Ivie et al. | 175/340 |
| 5,096,005 A | | 3/1992 | Ivie et al. | 175/340 |

(Continued)

FOREIGN PATENT DOCUMENTS

GB 2408763 6/2005

OTHER PUBLICATIONS

Ho et al., "Vortex induction and mass entertainment in a small-aspect-ratio elliptic jet," J. Fluid Mech., vol. 179, pp. 383-405, 1987.

(Continued)

*Primary Examiner*—William P Neuder
(74) *Attorney, Agent, or Firm*—Baker Botts L.L.P.

(57) ABSTRACT

A rotary drill bit having one or more fluid nozzles is provided. Each nozzle may include interior surfaces designed to optimize hydraulic performance and efficiency of fluid flowing through the nozzle. The interior surfaces cooperate with each other to minimize turbulent fluid flow through the respective nozzle. Each nozzle may also include a discharge port or outlet with at least one Coanda surface operable to direct fluid flow in a direction which optimizes efficiency of transferring fluid energy to adjacent portions of a wellbore. The orientation of fluid flow from each nozzle may be directed to optimize cleaning of associated cutting structures and/or to minimize or prevent balling of formation cuttings.

22 Claims, 9 Drawing Sheets

U.S. PATENT DOCUMENTS

| | | | | |
|---|---|---|---|---|
| 5,230,389 | A | 7/1993 | Besson | 175/56 |
| 5,293,946 | A * | 3/1994 | Besson et al. | 175/424 |
| 5,332,048 | A | 7/1994 | Underwood et al. | 175/26 |
| 5,624,002 | A | 4/1997 | Huffstutler | 175/356 |
| 5,632,349 | A | 5/1997 | Dove et al. | 175/393 |
| 5,927,410 | A | 7/1999 | Greer et al. | 175/393 |
| 5,967,244 | A | 10/1999 | Arfele | 175/340 |
| 6,142,246 | A | 11/2000 | Dickinson, III et al. | 175/67 |
| 6,206,112 | B1 | 3/2001 | Dickinson, III et al. | 175/67 |
| 6,227,316 | B1 * | 5/2001 | Rohde | 175/340 |
| 6,290,006 | B1 | 9/2001 | Crawford | 175/339 |
| 6,863,137 | B2 | 3/2005 | Terry et al. | 175/92 |
| 2003/0196836 | A1 | 10/2003 | Larsen et al. | 175/340 |
| 2004/0238225 | A1 | 12/2004 | Larsen et al. | 175/340 |
| 2005/0121235 | A1 | 6/2005 | Larsen et al. | 175/340 |
| 2005/0189148 | A1 | 9/2005 | Larsen et al. | 175/339 |
| 2005/0217899 | A1 | 10/2005 | Hossain et al. | 175/340 |
| 2006/0054355 | A1 | 3/2006 | Larsen et al. | 175/40 |
| 2006/0076163 | A1 | 4/2006 | Terracina et al. | 175/393 |
| 2008/0121434 | A1 * | 5/2008 | Wells et al. | 175/340 |

OTHER PUBLICATIONS

"Blast from the past wins a new fan," http://fplreflib.findlay.co.uk/articles/1083/coanda.htm, 2 pgs., Oct. 1998.

* cited by examiner

ROTARY DRILL BIT WITH NOZZLES DESIGNED TO ENHANCE HYDRAULIC PERFORMANCE AND DRILLING FLUID EFFICIENCY

RELATED APPLICATION

This application claims the benefit of provisional patent application entitled "Rotary Drill Bit With Nozzles Designed to Enhance Hydraulic Performance and Drilling Fluid Efficiency," Application Ser. No. 60/710,452 filed Aug. 23, 2005.

TECHNICAL FIELD

The present disclosure is related to rotary drill bits having fluid nozzles and more particularly rotary drill bits which use drilling fluids to clean associated cutting structures and lift formation cuttings to an associated well surface.

BACKGROUND

Various types of rotary drill bits have been used to form wellbores or bore holes in downhole formations. Such wellbores are often formed using a rotary drill bit attached to the end of a generally hollow, tubular drill string extending from an associated well surface. Rotation of a rotary drill bit progressively removes adjacent portions of a downhole formation by contact between cutting elements and cutting structures disposed on exterior portions of the rotary drill bit. Various types of drilling fluids are often used in conjunction with rotary drill bits to form wellbores or bore holes extending from a well surface through one or more downhole formations.

Bottom hole assemblies (BHA) are often included as part of a drill string. Drill collars and other components associated with rotary drilling of wellbores may be included in a bottom hole assembly. A downhole drilling motor may also be included as part of a bottom hole assembly to aid in rotation of an associated rotary drill bit. Downhole drilling motors, rotary steering tools and/or directional drilling tools are frequently used when forming horizontal wellbores, extended reach wellbores and highly deviated wellbores.

Rotary drill bits generally include a bit body with an enlarged fluid cavity formed therein. Drilling fluid may be communicated from an attached drill string to the enlarged fluid cavity formed within the bit body. One or more drilling fluid passageways may extend from the enlarged cavity to respective nozzle receptacles or opening formed in exterior portions of the bit body. Nozzles may be engaged with respective receptacles or openings formed in the bit body. Such nozzles often have a central passageway operable to receive drilling fluid supplied through the attached drill string to the enlarged cavity formed in the bit body. The nozzles are typically oriented to direct a fluid stream exiting from each nozzle. Such nozzles may control the pattern and velocity of associated fluid streams.

The nozzles may direct drilling fluid flow to flush and remove formation cuttings from the end or bottom of the bore hole. The nozzles may also direct drilling fluid to clean associated cutting elements and cutting structures to prevent clogging and balling of the cutting elements and cutting structures by formation cuttings and other downhole debris. Drilling fluid may be used to cool various components of a rotary drill bit. Drilling fluid may also be directed from one or more nozzles to abrade or erode adjacent formation materials to enhance forming an associated bore hole using hydraulic drilling techniques.

Bit bodies often include internally threaded nozzle receptacles that may receive externally threaded nozzle bodies. Nozzles having directional exit flow patterns may be firmly anchored within associated nozzle receptacles to prevent undesired axial or angular movement. Various techniques have been previously used to prevent undesired movement of nozzles within associated nozzle receptacles.

SUMMARY

In accordance with teachings of the present disclosure, a rotary drill bit may be provided with nozzles having increased fluid flow rates and increased downhole fluid energy. The nozzles may include one or more Coanda surfaces to control direction and pattern of a fluid stream exiting from each nozzle. Such nozzles may provide relatively narrow flow patterns with reduced spreading of the flow pattern to optimize performance of an associated rotary drill bit. For example, each nozzle may provide a desired flow angle, flow pattern and flow rate to optimize rate of penetration (ROP), removal of formation cuttings and increase downhole drilling life of an associated rotary drill bit. The present disclosure allows optimizing nozzle design and associated rotary drill bit design based on anticipated downhole drilling environments.

Technical benefits may include providing a rotary drill bit with nozzles which substantially increase hydraulic efficiency of drilling fluid exiting from the nozzles and increase the rate of penetration (ROP) of the drill bit. Orientation of each nozzle and/or direction of fluid flow from each nozzle may be optimized to produce a coherent hydraulic system of fluid flow paths that do not work against or interfere with each other.

For some embodiments, a fluid flow passageway and/or an outlet portion of each nozzle may be designed to increase the amount of shear stress applied by an associated fluid stream to the bottom or end of a wellbore to improve removal of formation materials as part of drilling the wellbore. The fluid flow passageway and/or outlet portion of each nozzle may also be designed to optimize lifting of formation cuttings, loose formation materials and/or other downhole debris to an associated well surface. The fluid flow passageway and associated outlet portion may include one or more surfaces which cooperate with each other to improve discharge coefficient of an associated nozzle and minimize hydraulic losses as a fluid stream exits from each nozzle.

Another aspect may include designing a rotary drill bit and associated nozzles to eliminate or substantially reduce areas of stagnate fluid flow. Any remaining areas of stagnate fluid flow may be moved away from associated cutting elements and cutting structures. Eliminating stagnant fluid flow and/or shifting stagnation lines away from associated cutting elements and cutting structures may significantly reduce loss of hydraulic energy of respective fluid streams exiting from the nozzles. Shifting stagnation lines and/or eliminating areas of stagnate fluid may substantially reduce or eliminate "redrilling" of formation cuttings and other downhole debris trapped between associated cutting elements and cutting structures and adjacent portions of the wellbore.

Other aspect may include a rotary drill bit and associated nozzles designed to create increased swirl of fluid flow in an annulus formed between exterior portions of a drill string attached with the rotary drill bit and adjacent portions of an associated wellbore. Increasing swirl of fluid flow in the annulus may substantially improve removal of formation cuttings and other downhole debris by maintaining relatively steady fluid flow rates in an upward direction towards an associated well surface. Reducing unsteady or varying flow conditions in the annulus may prevent or substantially reduce formation cuttings, downhole debris and/or other suspended solids from moving downward in portions of the annulus with lower fluid velocity. Maintaining relatively constant, upward fluid flow rates may be particularly beneficial when drilling extended reach, highly deviated and/or horizontal wellbores. For a given amount of hydraulic power, drilling fluid exiting from nozzles incorporating teachings of the present disclosure may flow faster through an associated annulus and may be able to remove larger sized formation cuttings and other downhole debris from the bottom or end of a wellbore to an associated well surface.

Technical benefits may include, but are not limited to, generating a coherent fluid stream (jet stream) exiting from a nozzle at a selected deflection angle such as approximately six (6°) or seven (7°) degrees. For some drill bit designs nozzles with deflection angles of approximately forty-five (45°) degrees may be used. However, nozzles with deflection angles between approximately zero (0°) degrees and approximately ninety (90°) degrees may also be used. For other applications, nozzles may have deflection angles greater than ninety (90°) degrees and may approach one hundred eighty (180°) degrees. For example, nozzles associated with fixed cutter drill bits may have deflection angles in the range of one hundred twenty (120°) degrees to one hundred forty (140°) degrees to direct fluid flow through associated junk slots.

Nozzles incorporating teachings of the present disclosure may direct jet streams for optimum removal of formation cuttings from between adjacent roller cones of a rotary cone drill bit or from junk slots of a fixed cutter drill bit. Recirculation of fluid in junk slots of fixed cutter drill bits may be enhanced or reduced based on nozzle position and direction of a jet stream exiting therefrom. Orientation and dispersion of such jet streams may be designed to prevent balling of formation cuttings and obstruction of fluid flow adjacent to cutting structures and other exterior portions of a rotary drill bit.

Spread or dispersion of a fluid stream existing from a nozzle incorporating teachings of the present disclosure may be less than twenty (20°) degrees. For some applications fluid exiting from a nozzle may be split into a primary jet stream and one or more secondary jet streams. For other applications fluid exiting from a nozzle may be a single, coherent, relatively narrow fluid flow stream or jet stream.

BRIEF DESCRIPTION OF THE DRAWINGS

A more complete and thorough understanding of the present disclosure and advantages thereof may be acquired by referring to the following description taken in conjunction with the accompanying drawings, in which like reference numbers indicate like features, and wherein.

DETAILED DESCRIPTION OF THE DISCLOSURE

Preferred embodiments of the present disclosure and various advantages may be understood by referring to FIGS.

1-15C of the drawings, like numerals being used for like and corresponding parts of the various drawings.

Figure 1:
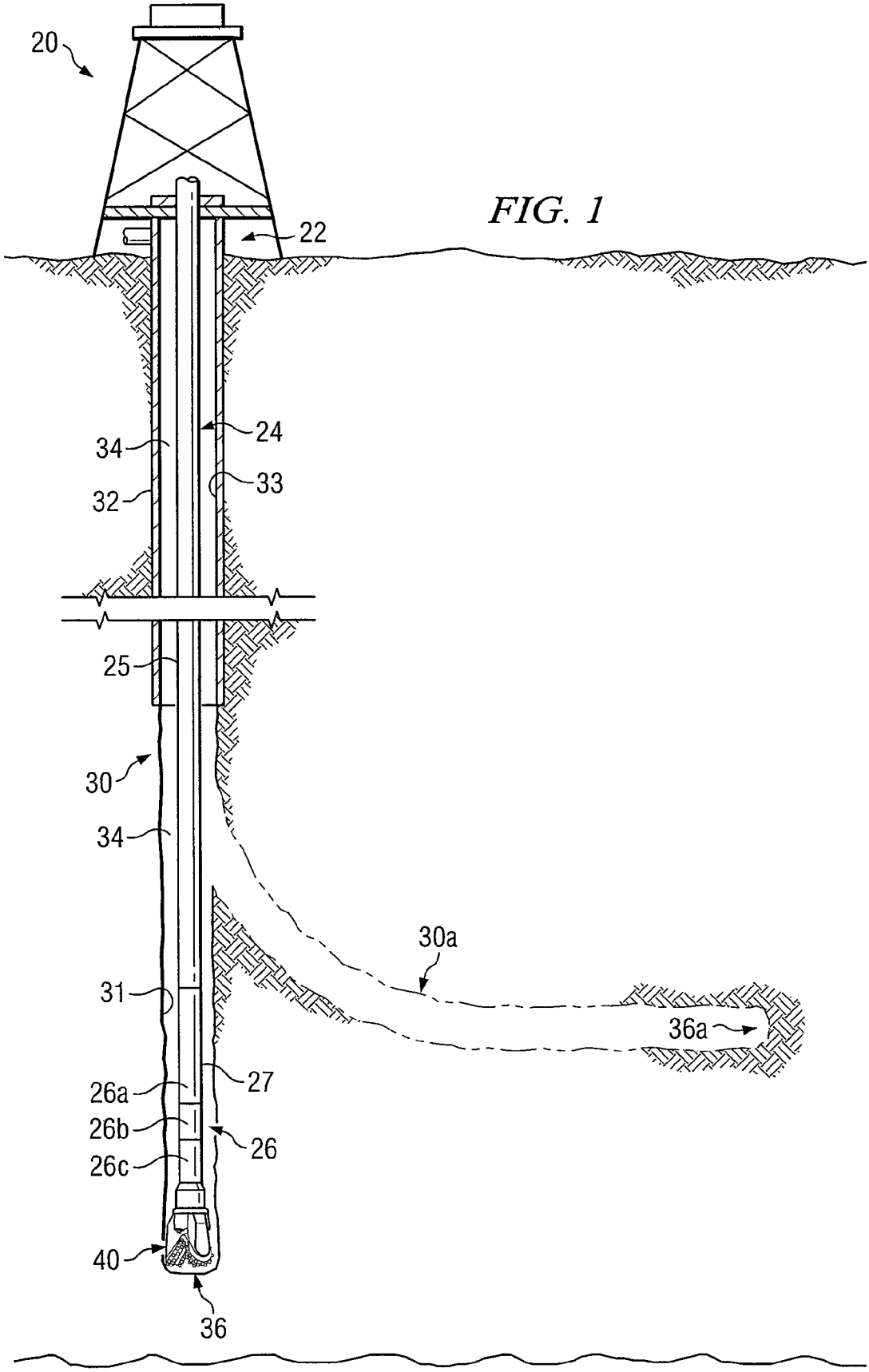
FIG. 1 is a schematic drawing in section and in elevation with portions broken away showing examples of wellbores which may be formed by a rotary drill bit incorporating teachings of the present disclosure.
Figure 2A:
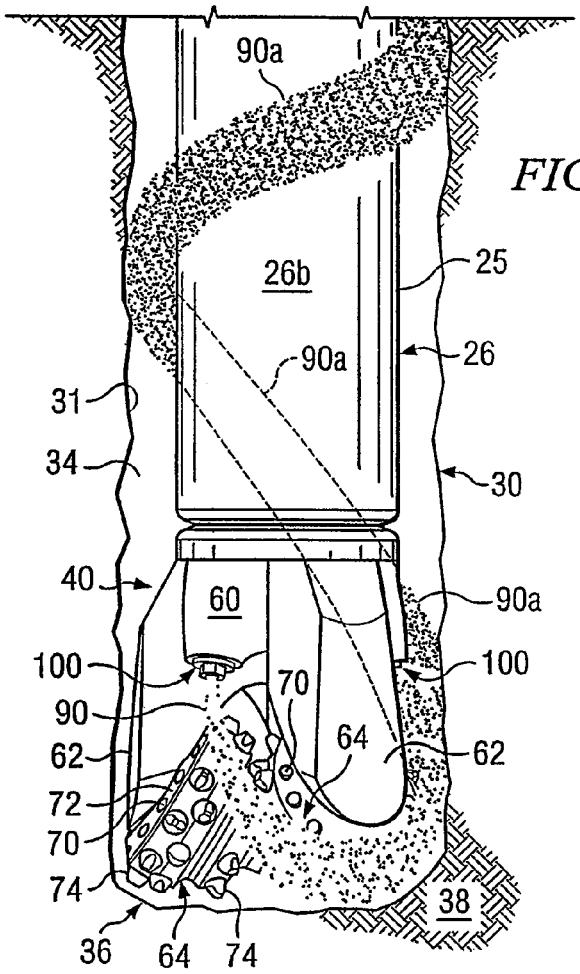
FIG. 2A is a schematic drawing in elevation and in section with portions broken away showing one example of a rotary drill bit incorporating teachings of the present disclosure attached to one end of a drill string while forming a wellbore.
Figure 2B:
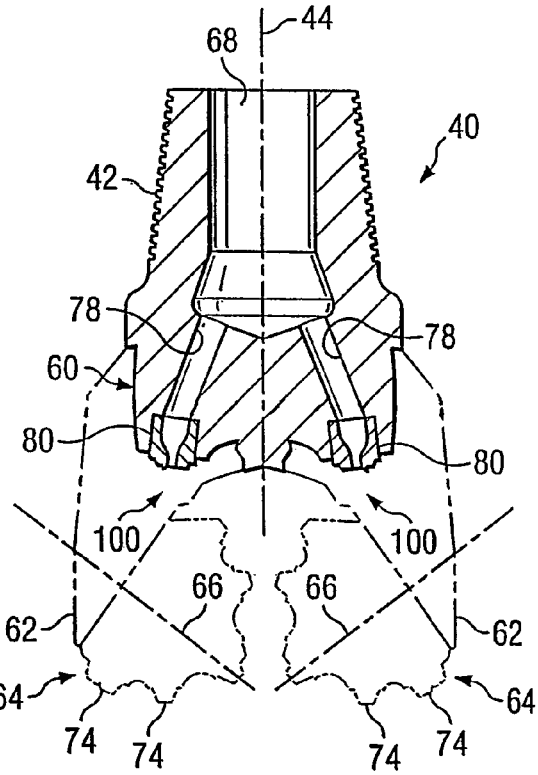
FIG. 2B is a schematic drawing in section with portions broken away showing portions of a roller cone drill bit and nozzles incorporating teachings of the present disclosure.
Figure 3A:
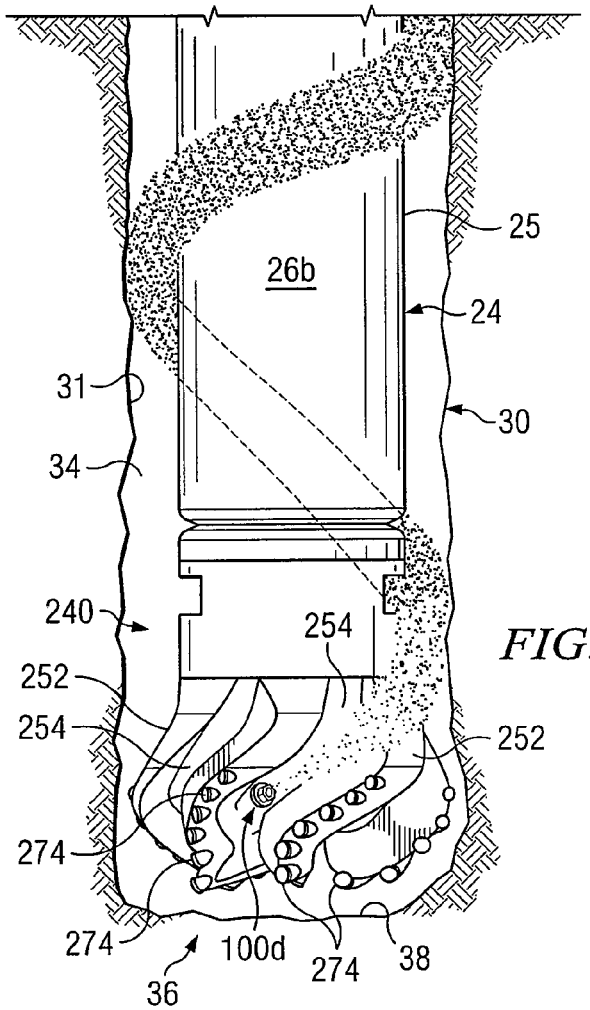
FIG. 3A is a schematic drawing in elevation and in section with portions broken away showing another example of a rotary drill bit incorporating teachings of the present disclosure attached to one end of a drill string while forming a wellbore.
Figure 3B:
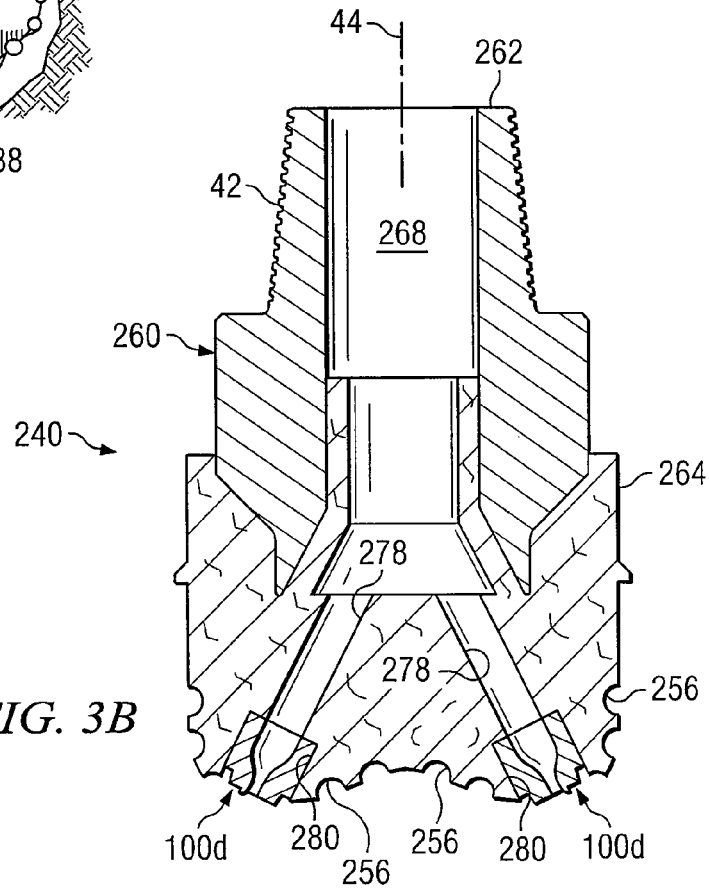
FIG. 3B is a schematic drawing in section with portions broken away showing portions of a fixed cutter drill bit and nozzles incorporating teachings of the present disclosure.
Figure 4:
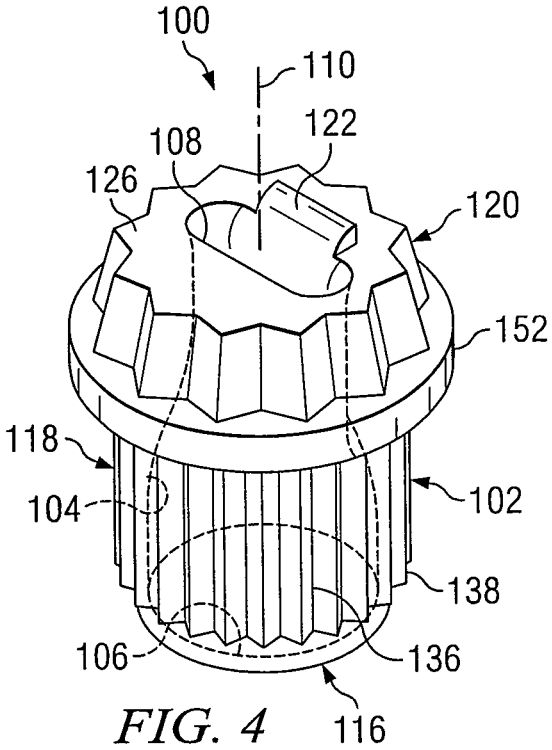
FIG. 4 is a schematic drawing showing an isometric view of one example of a nozzle incorporating teachings of the present disclosure.

The terms "rotary drill bit" and "rotary drill bits" may be used in this application to include various types of roller cone drill bits, rotary cone drill bits, fixed cutter drill bits, drag bits and matrix drill bits. Rotary drill bits and associated nozzles incorporating teachings of the present disclosure may have many different designs and configurations. Rotary drill bit 40 such as shown in FIGS. 1, 2A and 2B and rotary drill bit 240 such as shown in FIGS. 3A and 3B represent only two examples of rotary drill bits which may be formed in accordance with teachings of the present disclosure.

The terms "cutting element" and "cutting elements" may be used in this application to include various types of compacts, cutters, inserts, milled teeth, gauge cutters, impact arrestors and/or welded compacts satisfactory for use with a wide variety of rotary drill bits. Polycrystalline diamond compacts (PDC) and tungsten carbide inserts are often used to form cutting elements for rotary drill bits. A wide variety of other types of hard, abrasive materials may also be satisfactorily used to form such cutting elements.

The terms "cutting structure" and "cutting structures" may be used in this application to include various combinations and arrangements of cutting elements formed on or attached to one or more cone assemblies of a roller cone drill bit. The terms "cutting structure" and "cutting structures" may also be used in this application to include various combinations and arrangements of cutting elements formed on exterior portions of fixed cutter drill bits. Some fixed cutter drill bits may include one or more blades extending from an associated bit body with cutting elements disposed of each blade. Various configurations of blades and cutting elements may be used to form cutting structures for a fixed cutter drill bit.

The terms "drilling fluid" and "drilling fluids" may be used to describe various liquids and mixtures of liquids and suspended solids associated with rotary well drilling techniques. Some mixtures of liquids and suspended solids may be described as "drilling mud." However, some drilling fluids may be primarily liquids depending upon associated downhole drilling environments. A wide variety of chemical compounds may be added to drilling fluid as appropriate for associated downhole drilling conditions and formation materials. For some special drilling techniques and downhole formations, air or other suitable gases may be used as a drilling fluid.

The term "Coanda effect" may be used in this application to describe a boundary layer flow stream and/or turbulent flow stream (jet stream) which adheres to a curved or angled surface without creating counter currents in the respective flow stream. Such flow streams may be formed by a wide variety of fluids, liquids and/or gases. Such flow streams may include a wide variety of suspended solids.

Fluid flow rates or discharge flow rates associated with drilling fluid exiting from one or more nozzles of a rotary drill bit are generally high. Turbulent fluid flow is a common characteristic of drilling fluid exiting from such nozzles. Formation of counter currents in drilling fluid exiting from nozzles of a rotary drill bit will generally increase loss of hydraulic energy and reduce hydraulic efficiency.

The terms "fluid stream" and "jet stream" may be used in this application to describe any combination of fluids, liquids, gases and/or suspended solids which may adhere with one or more convex surfaces or divergent surfaces (Coanda effect) associated with a nozzle incorporating teachings of the present disclosure. Adherence of turbulent fluid streams to a divergent surface (Coanda effect) often minimizes loss of hydraulic energy and maximizes hydraulic efficiency of an associated nozzle.

The terms "Coanda surface" and "Coanda surfaces" may be used in this application to describe various divergent surfaces or convex surfaces which produce a Coanda effect. The use of Coanda surfaces may provide greater flexibility in designing nozzles with optimum flow angles (deflection), optimum flow patterns (spread or dispersion) and optimum hydraulic efficiency for an associated rotary drill bit design and anticipated downhole drilling environment. Coanda surfaces may also direct the turbulent fluid streams with a desired orientation relative to cutting structures of an associated rotary drill bit and/or adjacent portions of a wellbore.

Conventional nozzles associated with rotary drill bits often have a generally circular outlet. The back pressure of fluid flowing through such nozzles often depends upon fluid flow rate and diameter of an associated nozzle outlet or discharge port. For example, for a given nozzle outlet diameter such as 12/32 of an inch, back pressure will generally increase as fluid flow through an associated nozzle increases. Also, for a given flow rate such as one hundred gallons per minute, back pressure within a conventional nozzle will generally increase as diameter of an associated nozzle outlet is decreased. Alternatively, back pressure will generally decrease for conventional nozzles having a larger outlet diameter.

Some nozzles associated with rotary drill bits may have more complex geometries than a standard circular outlet. See for example nozzles shown in U.S. Pat. Nos. 6,065,683 and 5,992,763. Nozzles with more complex discharge ports often have larger back pressures and thus reduced hydraulic efficiency as compared to conventional nozzles with circular discharge ports having substantially the same effective flow area. Nozzles with more complex outlet geometries may deflect fluid streams to set up conditions necessary to initiate swirling flow paths that leads to an organized flow field in a well annulus. Such nozzles may experience an average efficiency penalty of approximately six (6%) percent based on discharge coefficients when compared to conventional nozzles. Such nozzles may deflect fluid streams in the range of fifteen (15°) degrees to twenty (20°) degrees.

One aspect of the present disclosure may include designing Coanda surfaces which may be added to conventional nozzles (see for example FIG. 12) or any other nozzle (see for example FIG. 11) associated with rotary drill bits. Coanda surfaces may be designed in accordance with teachings of the present disclosure to optimize transition of fluid flow and to minimize any increase in turbulence of such fluid. The amount of dispersion (also referred to as "spreading" or "pattern") of a fluid stream exiting from a nozzle may be controlled to minimize hydraulic losses and maximize work performed by the fluid stream. For some applications design parameters such as deflection angle and spreading of a fluid stream exiting a nozzle may be modified by changing only the configuration and/or dimensions of a Coanda surface formed on an outlet portion of the nozzle without changing other features of an associated nozzle body.

Nozzles formed with Coanda surfaces incorporating teachings of the present disclosure typically have reduced back pressure with the same fluid flow rate and the same effective flow area as compared with a conventional nozzle having a circular outlet. Therefore, hydraulic efficiency of nozzles with one or more Coanda surfaces may be substantially increased as compared with both conventional nozzles with generally circular discharge ports and nozzles having discharge ports with more complex configurations. Coanda surfaces formed in a nozzle in accordance with teachings of the present disclosure may optimize transition of fluid flow through the nozzle. Coanda surfaces may be designed in accordance with teachings of the present disclosure to prevent loss of fluid efficiency and to minimize fluid separation or turbulence of fluid flowing over such surfaces.

Coanda surfaces may be designed in accordance with teachings of the present disclosure to shift and/or eliminate fluid stagnation lines at the bottom or end of a bore hole or wellbore. The position of stagnations lines may be primarily a function of impingement angles between fluid streams exiting from associated nozzles and the end or bottom of a wellbore. Changes in design and configuration of Coanda surfaces may substantially change the position of such stagnation lines.

For some applications, nozzles and/or Coanda surfaces may be designed in accordance with teaching of the present disclosure using various computational fluid dynamics (CFD) programs such as, but not limited to, Fluent version 6.1 with a K-epsilon turbulence model available from Fluent Inc. Fluent Inc. is a wholly owned subsidiary of ANSIS, Inc. Fluent Inc. has offices in various locations including Lebanon and New Hampshire. Various computer programs including, but not limited to, CATIA version 5.10 may also be satisfactorily used to design Coanda surfaces and/or nozzles in accordance with teachings of the present disclosure. CATIA version 5.10 is available from IBM and Dassault Systems.

Coanda surfaces may be designed in accordance with teachings of the present disclosure to shift and/or eliminate fluid stagnation lines at the bottom or end of a bore hole or wellbore. The position of stagnations lines may be primarily a function of impingement angles between fluid streams exiting from associated nozzles and the end or bottom of a wellbore. Changes in design and configuration of Coanda surfaces may substantially change the position of such stagnation lines.

Nozzles 100, 100*d*, 200 and 300 and other nozzles incorporating teachings of the present disclosure may produce fluid streams with strong sweeping action over the end of wellbore to increase acceleration and removal of formation cuttings. The orientation of respective fluid streams existing from nozzles 100, 100*d*, 200 and 300 may be selected to create strong swirling fluid flow in an associated annulus to reduce unsteadiness of such fluid flow. Such nozzles may be installed in existing drill bits to significantly improve drilling performance without requiring a major redesign of such drill bits.

For some applications Coanda surfaces associated with nozzles 100, 100*d*, 200 and/or 300 may reduce peak fluid pressure within an associated fluid passageway as a result of improved transition of drilling fluid flowing therethrough. The reduction of maximum or peak fluid pressure may result in greater impingement energy to increase sheer stresses over the end of wellbore to increase efficiency of removing formation cuttings therefrom.

Figure 11:
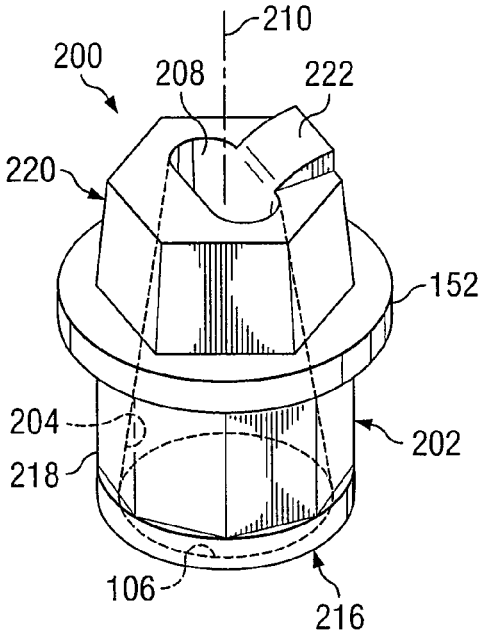
FIG. 11 is a schematic drawing showing an isometric view of another example of a nozzle incorporating teachings of the present disclosure.
Figure 12:
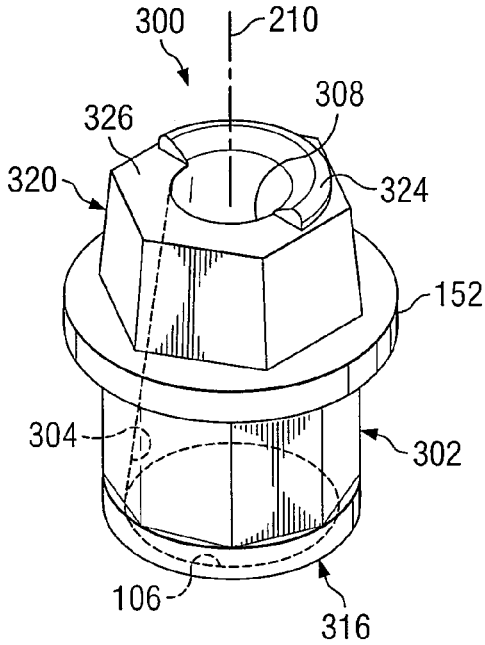
FIG. 12 is a schematic drawing showing an isometric view of still another example of a nozzle incorporating teachings of the present disclosure.

Some aspects of the present disclosure may be described with respect to nozzle 100 (FIGS. 2A-4, 8, 13A and 14A-14C), nozzle 100*d* (FIGS. 5, 6, 7, 13B and 15A-C), nozzle 200 (FIG. 11) and nozzle 300 (FIG. 12). U.S. Pat. No. 5,972,410 entitled "Drill Bit Nozzle And Method Of Attachment" and U.S. Pat. No. 5,967,244 entitled "Drill Bit Directional Nozzle" describe various techniques and procedures which may be satisfactorily used to engage a nozzle with a nozzle housing or nozzle receptacle formed in a bit body. However, a wide variety of techniques and procedures may be satisfactorily used to engage nozzles 100, 100*d*, 200 and 300 or any other nozzle incorporating teachings of the present disclosure with a rotary drill bit.

FIG. 1 is a schematic drawing in elevation and in section with portions broken away showing examples of wellbores or bore holes which may be formed in accordance with teachings of the present disclosure. Various aspects of the present disclosure may be described with respect to drilling rig 20 located at well surface 22.

Various types of drilling equipment such as a rotary table, mud pumps and mud tanks (not expressly shown) may be located at well surface 22. Drilling rig 20 may have various characteristics and features associated with a "land drilling rig." However, rotary drill bits and nozzles formed in accordance with teachings of the present disclosure may be satisfactorily used with drilling equipment located on offshore platforms, drill ships, semi-submersibles and drilling barges (not expressly shown).

Rotary drill bit 40 such as shown in FIGS. 1, 2A and 2B or rotary drill bit 240 such as shown in FIGS. 3A and 3B may be attached with the extreme end of drill string 24 extending from well surface 22. Drill string 24 may be formed from sections or joints of generally hollow, tubular drill pipe (not expressly shown). Drill string 24 may also include bottom hole assembly 26 formed from a wide variety of components. For example components 26*a*, 26*b* and 26*c* may be selected from the group consisting of, but not limited to, drill collars, rotary steering tools, directional drilling tools and/or downhole drilling motors. The number of components such as drill collars and different types of components in a bottom hole assembly will depend upon anticipated downhole drilling conditions and the type of wellbore which will be formed by drill string 24 and rotary drill bit 40 or 240.

Rotary drill bit 40 or 240 may be attached with bottom hole assembly 26 at the extreme end of drill string 24. Bottom hole assembly 26 will generally have an outside diameter compatible with other portions of drill string 24. Drill string 24 and rotary drill bit 40 or 240 may be used to form various types of wellbores and/or bore holes. For example, horizontal wellbore 30*a*, shown in FIG. 1 in dotted lines, may be formed using drill string 24 and rotary drill bit 240. Various directional drilling techniques may be used to form horizontal wellbore 30*a*.

Wellbore 30 may be defined in part by casing string 32 extending from well surface 22 to a selected downhole location. As shown in FIGS. 1, 2A and 3A remaining portions of wellbore 30 may be described as "open hole" (no casing). Various types of drilling fluid may be pumped from well surface 22 through drill string 24 to attached rotary drill bit 40 or 240. The drilling fluid may be circulated back to well surface 22 through annulus 34 defined in part by outside diameter 25 of drill string 24 and inside diameter 31 of wellbore 30. Inside diameter 31 may also be referred to as the "sidewall" of wellbore 30. Annulus 34 may also be defined by outside diameter 25 of drill string 24 and inside diameter 33 of casing string 32.

The type of drilling fluid used to form wellbore 30 may be selected based on design characteristics associated with rotary drill bit 40 or 240, characteristics of anticipated downhole formations and any hydrocarbons or other fluids produced by one or more downhole formations adjacent to wellbore 30. Different types of drilling fluid may be used depending upon specific characteristics of each downhole formation being drilled.

Drilling fluids may be used to remove formation cuttings and other downhole debris (not expressly shown) from wellbore 30 to well surface 22. Formation cuttings may be formed by rotary drill bit 40 or rotary drill bit 240 engaging end 36 of wellbore 30. End 36 may sometimes be described as "bottom hole" 36. Formation cuttings may also be formed by rotary drill bit 40 or 240 engaging end 36*a* of horizontal wellbore 30*a*.

Drilling fluids may also be used to clean, cool and lubricate cutting elements, cutting structures and other components associated with rotary drill bits 40 and 240. Drilling fluids may assist in breaking away, abrading and/or eroding adjacent portions of downhole formation 38. See FIGS. 2A and 3A.

Drilling fluids may be used for well control by maintaining desired fluid pressure equilibrium within wellbore 30. The weight or density of drilling fluid is generally selected to prevent undesired fluid flow from an adjacent downhole formation into a wellbore and also to prevent undesired flow of the drilling fluid from the wellbore into the downhole formations. Drilling fluids may also provide chemical stabilization for formation materials adjacent to a wellbore and may prevent or minimize corrosion of a drill string, bottom hole assembly and/or attached rotary drill bit.

Rotary drill bit 40 may sometimes be referred to as a "rotary cone drill bit" or "roller cone drill bit." Rotary drill bit 40 may also be referred to as a "tri-cone drill bit." However, rotary drill bits having one cone, two cones or more than three cones may also include nozzles and other features of the present disclosure.

Rotary drill bit 40 may include bit body 60 having tapered, externally threaded, upper portion 42 satisfactory for use in attaching rotary drill bit 40 with the extreme end of drill string 24. A wide variety of threaded connections may be satisfactorily used to allow rotation of rotary drill bit 40 in response to rotation of drill string 24 at well surface 22.

Bit body 60 may be formed from three segments which include substantially identical support arms 62 extending therefrom. The segments may be welded with each other using conventional techniques to form bit body 60. Enlarged cavity 68 may be formed adjacent to upper portion 42 to receive drilling fluid from drill string 24.

Only two support arms 62 are shown in FIGS. 2A and 2B. The lower portion of each support arm 62 may include a respective shaft, bearing pin or spindle (not expressly shown). Cone assemblies 64 may be rotatably mounted on respective spindles extending from associated support arm 62. Cone assemblies 64 may also be described as roller cone assemblies, cutter cone assemblies or rotary cone assemblies.

Each cone assembly 64 may include respective axis of rotation 66 extending at an angle corresponding with the angular relationship between each spindle and associated support arm 62. Axis of rotation 66 often corresponds with the longitudinal center line of the respective spindle. Axis of rotation 66 of each cone assembly 64 may be offset relative to rotational axis 44 of rotary drill bit 40. Various features of the present disclosure may be described with respect to bit rotational axis 44 of the rotary drill bits 40 and 240.

For some applications a plurality of compacts 70 may be disposed in backface 72 of each cone assembly 64. Compacts 70 may be used to "trim" inside diameter 31 of wellbore 30 and prevent other portions of backface 72 from contacting adjacent portions of formation 38. For some applications compacts 70 may be formed from polycrystalline diamond type materials or other suitable hard, abrasive materials.

Each cone assembly 64 may also include a plurality of cutting elements 74 arranged in respective rows. A gauge row of cutting elements 74 may be disposed adjacent to backface 72 of each cone assembly 64. The gauge row may also sometimes be referred to as the "first row" of inserts. Cutting elements 74 may be formed from a wide variety of materials such as tungsten carbide. The term "tungsten carbide" includes monotungsten carbide (WC), ditungsten carbide ($W_2C$), macrocrystalline tungsten carbide and cemented or sintered tungsten carbide. Examples of hard materials which may be satisfactorily used to form compacts 70 and cutting elements 74 include various metal alloys and cermets such as metal borides, metal carbides, metal oxides and metal nitrides.

Inserts 74 may scrape and gouge the sides and bottom of wellbore 30 in response to weight and rotation applied to rotary drill bit 40 by drill string 24. The position of inserts 74 on each cone assembly 64 may be varied to provide desired downhole drilling action. Other types of cone assemblies may be satisfactorily used with the present disclosure including, but not limited to, cone assemblies having milled teeth (not expressly shown) instead of inserts 74 and compacts 70.

As shown in FIG. 1, drill string 24 may apply weight to and rotate rotary drill bit 40 to form wellbore 30. The interior diameter or sidewall 31 of wellbore 30 corresponds approximately with the combined outside diameter of cone assemblies 64 attached with rotary drill bit 40. In addition to rotating and applying weight to rotary drill bit 40, drill string 24 may be used to provide a conduit for communicating drilling fluids and other fluids from well surface 22 to drill bit 40 at end 36 of wellbore 30. Such drilling fluids may be directed to flow from drill string 24 to respective nozzles 100 provided in rotary drill bit 40.

A plurality of drilling fluid passageways 78 may be formed in bit body 60. Each drilling fluid passageway 78 may extend from enlarged cavity 68 to respective opening or receptacle 80 formed in bit body 60. The location of receptacles 80 may be selected based on desired locations for associated nozzles 100.

Formation cuttings formed by rotary drill bit 40 and any other downhole debris at end 36 of wellbore 30 will mix with drilling fluids exiting from nozzles 100. The mixture of drilling fluid, formation cuttings and other downhole debris will generally flow radially outward from beneath rotary drill bit 40 and then flow upward to well surface 22 through annulus 34.

While drilling with a rotary drill bit, fluid flow in the vicinity of cutting elements or cutting structures may be very turbulent and may inhibit or even prevent upward flow of cuttings and other debris from the bottom of a wellbore through an annulus extending to the well surface. Furthermore, such debris may collect in downhole locations with restricted fluid flow. Examples of such locations with restricted fluid flow may include the lower portion of a bit body adjacent to respective cutting structures and the annulus area between the exterior of a bit body and adjacent sidewall of a wellbore. Other areas of restricted flow may include the back face of respective rotary cones and the sidewall of a wellbore.

As a result of collecting formation cuttings and other debris, available area for fluid flow may be reduced which further increases fluid velocity through such areas and erosion of adjacent metal components. As this erosion progresses, vital components such as bearings and seals (not expressly shown) may be exposed to drilling fluids, formation cuttings and other debris which may lead to premature failure of an associated rotary drill bit.

As discussed later in more detail, various features of the present disclosure may substantially reduce or eliminate areas of stagnate fluid flow between exterior portions of a rotary drill bit and adjacent portions of a wellbore. The present disclosure may also prevent undesired changes in the velocity of fluid mixtures flowing in an annulus formed between a drill string and the sidewall of a wellbore. See for example well annulus 34.

Bit body 60 will often be substantially covered by a mixture of drilling fluid and formation cuttings and other downhole debris while drilling string 24 rotates rotary drill bit 40. For purposes of illustrating various feature of the present disclosure only one nozzle 100, fluid stream 90 exiting therefrom, and associated flow stream 90*a* is shown in FIG. 2A.

The location of each nozzle 100 on rotary drill bit 40 and the direction of a respective stream of drilling fluid exiting from each nozzle 100 may be selected to enhance drilling efficiency of rotary drill bit 40. Nozzles 100 associated with rotary drill bit 40 may cooperate with each other to produce a generally smooth, upward spiral of drilling fluid flow mixed with formation cuttings and other downhole debris from end or bottom 36 of wellbore 30 to associated well surface 22.

For example, the most effective way to remove formation cuttings may be to orient fluid streams exiting from nozzles 100 such that a relatively stable swirling pattern may be produced within well annulus 34. Such swirling patterns may organize fluid flow within well annulus 34 to help reduce hydraulic losses and more quickly remove formation cuttings generated by rotary drill bit 40 from the end or bottom of wellbore 30.

For some applications, a relatively steep ascending swirling motion may increase overall hydrodynamic efficiency of a rotary drill bit and associated fluid systems. An ascending upward swirling motion may generally accelerate removal of formation cuttings and other down hole debris from the end of a wellbore and may result in an increased rate of penetration for an associated rotary drill bit.

The optimum orientation for fluid streams existing from each nozzle of a rotary drill bit may be determined in accordance with teachings of the present disclosure. For example nozzle orientations may be based upon minimizing direct impingement of drilling fluid on associated cutting structures, creating a strong upward swirling motion and eliminating or reducing areas of stagnant fluid flow between cutting structures of an associated rotary drill bit and the bottom or end of a wellbore.

For some applications, rotary drill bit 40 and/or rotary drill bit 240 may be placed in a test module (not expressly shown) to observe flow patterns from associated nozzles. The position of each nozzle may be modified for each test to record the results of swirling motion and/or mixing with each orientation. With this optimum orientation the angle of fluid flow stream 90*a* as shown in FIGS. 2A and 3A may vary between approximately twenty-eight (28°) degrees and thirty-eight (38°) degrees relative to a horizontal axis.

For embodiments such as shown in FIG. 2A, fluid stream or jet stream 90 is shown exiting from associated nozzle 100 and flowing around adjacent cutter cone assembly 64 and bit body 60. Drilling fluid exiting from nozzle 100 may be relatively free from particulate matter such as formation cuttings. As fluid stream 90 contacts portions of wellbore 30, the concentration of particulate matter (formation cuttings and downhole debris) may substantially increase. The resulting flow stream 90*a* of drilling fluid and particulate matter is shown wrapping around bottom hole assembly 26 and drill string 24 above rotary drill bit 40.

For some applications mixtures of drilling fluid, formation cuttings and other downhole debris may follow in a generally spiraling flow path defined in part by a fluid stream which wraps around drill string 25 approximately four times per foot. The optimum number of spiraling wraps may vary based on downhole drilling conditions including, but not limited to, the type of formation cuttings, characteristics of the drilling fluid and associated well annulus. A single wrap of drilling fluid flow stream 90*a* such as shown in FIG. 2A may travel approximately three hundred sixty (360°) degrees relative to the exterior of drill string 24.

Establishment of a swirling, spiral flow stream within well annulus 34 represents one aspect of determining effectiveness of nozzles 100. A balance is often required between the energy required to organize desired fluid flow within well annulus 34 and efficiency of nozzles 100 in converting drilling fluid pressure into usable kinetic energy to remove formation materials from end 36 of wellbore 30 and to clean associated cutting structures of rotary drill bit 40. Discharge coefficient for various nozzle designs may be calculated and jet stream profile mapping based on laboratory testing may be used to determine an optimum balance between establishing a spiraling flow stream in well annulus 34 and using available fluid kinetic energy to sweep end 36 of wellbore 30. Evaluation of discharge coefficients for various nozzle designs will be discussed later in this application.

Orienting each nozzle 100 with one or more Coanda surfaces in accordance with teachings of the present disclosure may minimize undesired impact of associated fluid stream 90 with cutting elements and cutting structures associated with roller cone assemblies 64. Cross flow of drilling fluid exiting from associated nozzles 100 may be maximized between exterior portions of roller cone assemblies 64 and adjacent portions of wellbore 30 to substantially improve cleaning efficiency of the associated cutting elements and cutting structures and to minimize stagnation of fluid flow. Nozzles 100 may include one or more Coanda surfaces which improve associated hydraulic efficiency of drilling fluid exiting therefrom. The location of nozzles 100 and the direction of drilling fluid exiting from each nozzle 100 may maximize distribution of fluid impact pressure along end or bottom 36 of wellbore 30.

Rotary drill bit 240 as shown in FIGS. 3A and 3B may sometimes be referred to as a "fixed cutter drill bit" or "drag bit". Rotary drill bit 240 may also be described as a "matrix drill bit" depending upon techniques and procedures used to form an associated bit body 260.

Rotary drill bit 240 may include bit body 260 having tapered, externally threaded portion 42 satisfactory for use in attaching rotary drill bit 240 with the extreme end of drill string 24. For some applications bit body 260 may include metal shank 262 and matrix material 264 securely attached thereto. Examples of such matrix materials may include, but are not limited to, a wide variety of hard, brittle non-metallic refractory materials such as carbide, carbon nitrite, cemented carbides, macrocrystalline tungsten carbide powders. The matrix materials may include one or more binders selected from the group consisting of, but not limited to, copper, cobalt, nickel, iron and/or alloys of these materials.

Metal shank 262 may be described as having a generally hollow, cylindrical configuration defined in part by enlarged cavity 268. Tool joints with various types of threaded connections, such as American Petroleum Institute (API) threaded pin 42, may be provided on metal shank 262 opposite from matrix material 264. U.S. Pat. No. 5,373,907 entitled Method And Apparatus For Manufacturing And Inspecting The Quality Of A Matrix Body Drill Bit describes one example of techniques and procedures which may be satisfactorily used to form a matrix bit body.

Fixed cutter drill bits may include a plurality of cutting elements, inserts, cutter pockets, blades, cutting structures, junk slots, and/or fluid flow paths formed on or attached to exterior portions of an associated bit body. For embodiments such as shown in FIGS. 3A and 3B, a plurality of blades 252 may form on the exterior of bit body 260. Blades 252 may be spaced from each other on the exterior of bit body 260 to form fluid flow paths or junk slots 254 therebetween.

Cutting action or drilling action for rotary drill bit 240 occurs as cutting elements 274 attached to blades 252 scrape and gouge end 36 and adjacent portion of sidewall 31 of wellbore 30 during rotation of drill string 24. The resulting inside diameter 31 of wellbore 30 may correspond approximately with the outside diameter or gauge diameter of bit body 260. Blades 252 and cutting elements 274 cooperate with each other to form sidewall 31 of wellbore 30 in response to rotation of rotary drill bit 240 and weight applied to rotary drill bit 240 by drill string 24. Cutting elements 274 may sometimes be referred to as "inserts" or "compacts".

In addition to rotating and applying weight to rotary drill bit 240, drill string 24 may be used to provide a conduit for communicating drilling fluids and other fluids from well surface 22 to drill bit 240 at end 36 of wellbore 30. See FIG. 3A. Such drilling fluids may be directed to flow from drill string 24 to various nozzles 100 provided in rotary drill bit 240.

A plurality of pockets or recesses 256 may be formed in blades 252 at selected locations. Respective cutting elements or inserts 274 may be securely mounted in each pocket 256 to engage and remove adjacent portions of a downhole formation. Cutting elements 274 may scrape and gouge formation materials from the bottom and sides of a wellbore during rotation of rotary drill bit 240 by attached drill string 24.

U.S. Pat. No. 6,296,069 entitled Bladed Drill Bit with Centrally Distributed Diamond Cutters and U.S. Pat. No. 6,302,224 entitled Drag-Bit Drilling with Multiaxial Tooth Inserts show various examples of blades and/or cutting elements which may be used with incorporating teachings of the present disclosure. It will be readily apparent to persons having ordinary skill in the art that a wide variety of fixed cutter drill bits, drag bits and other drill bits may be satisfactorily formed with nozzles and other feature of the present disclosure.

Formation cuttings formed by rotary drill bit 240 and any other downhole debris at end 36 of wellbore 30 will mix with drilling fluids exiting from nozzles 100 and return to well surface 22 via annulus 34. The mixture of drilling fluid, formation cuttings and other downhole debris will generally flow outward from beneath rotary drill bit 240 and then upward towards well surface 22 through annulus 34.

Bit body 260 may include enlarged cavity 268 which receives drilling fluid from drill string 24. A plurality of drilling fluid passageways 278 may extend from enlarged cavity 268 to respect openings or receptacles 280 formed in bit body 260. The location of receptacles 280 may be selected based on desired locations for associated nozzles 100*d*. The location of receptacles 280 and orientation of associated nozzles 100*d* shown in FIG. 3B is for illustration purposes only. The location of one or more receptacles 280 may be modified to accommodate installing associated nozzle 100 in junk slot 254 between adjacent blades 252 as shown in FIG. 3A.

Various features and benefits may be discussed concerning using nozzle 100*d* with fixed cutter rotary drill bits. For example, nozzles 100*d* may be placed within junk slots 254 formed between adjacent blades 252. See FIG. 3A. Each nozzle 100*d* may include one or more Coanda surfaces operable to form a coherent, relatively narrow drill fluid flow stream. Each nozzle 100*d* may be oriented to direct the associated drilling fluid flow stream in an optimum direction to enhance removal of formation cuttings without impacting adjacent cutting elements and cutting structures. For example drilling fluid exiting from nozzle 100 as shown in FIG. 3A may flow between adjacent blade 252 without directly impinging associated cutting elements 274.

FIGS. 4-15C are schematic drawings showing examples of nozzles having one or more Coanda surfaces formed in accordance with teachings of the present disclosure. Nozzles 100, 100*d*, 200 and 300 as shown in FIGS. 4-15C may be satisfactorily used with a wide variety of rotary drill bits including, but not limited to, rotary drill bit 40 and rotary drill bit 240. Various features of the present disclosure as shown in FIGS. 4-15C may be described with respect to bit body 60. However, nozzles 100, 100*d*, 200 and 300 may also be engaged with bit body 260 or other bit bodies associated with rotary drill bits.

Nozzles 100 and 100*d* may have substantially the same nozzle body 102 as shown in FIGS. 4-7 and 14A-15C. As a result either nozzle 100 or nozzle 100*d* may be disposed in the same nozzle housing or receptacle 80 formed in bit body 60. As shown in FIGS. 4, 7, 14A and 15A, nozzle body 102 may be described as having a generally hollow, cylindrical configuration defined in part by inlet section 116 and outlet section 120 with respective fluid flow passageways 104 or 104*d* extending therebetween.

For some applications inlet 106 may have a generally circular configuration with a diameter of approximately 1.250 inches. Longitudinal axis or longitudinal center line 110 may extend from the center of inlet 106 through nozzle body 102. Various features and characteristics of nozzles 100 and 100*d* may be described with respect to longitudinal axis 110.

Figure 13A:
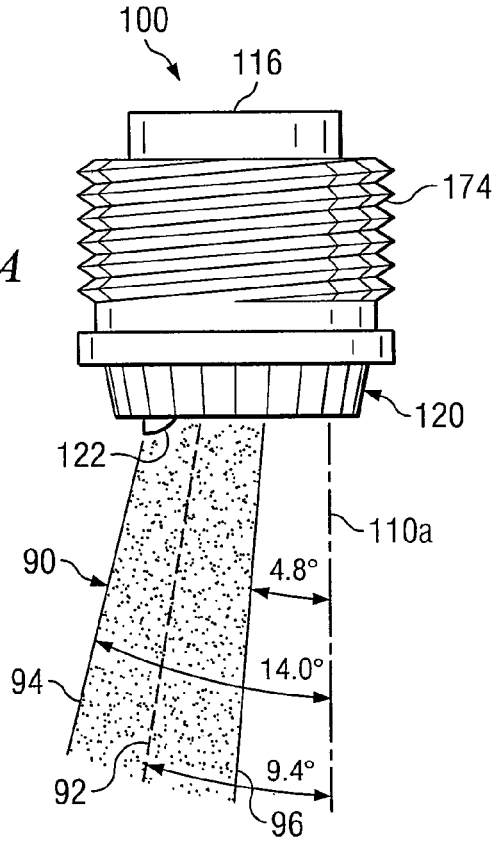
FIG. 13A is a schematic drawing showing an isometric view of a nozzle having an outlet portion incorporating teachings of the present disclosure.
Figure 13B:
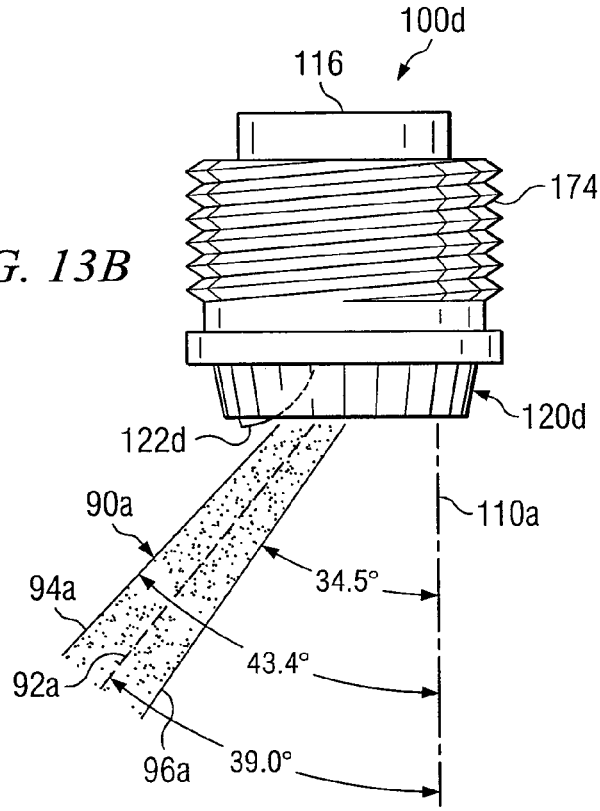
FIG. 13B is a schematic drawing showing an isometric view of another nozzle having an outlet portion incorporating teachings of the present disclosure.

Nozzle body 102 may also include middle portion or middle section 118 disposed between inlet section 116 and outlet section 120. The exterior surface of middle portion 118 may include a plurality longitudinal grooves 136 and ridges 138. See for example FIGS. 4, 6 and 7. For embodiments such as shown in FIGS. 13A and 13B, grooves 136 and ridges 138 may be replaced by threads 174. Annular ring or flange 152 may be formed on the exterior of nozzle body 102 between outlet portion 120 and middle portion 118.

Fluid flow passageway 104 of nozzle 100 may have a complex, variable geometry relative to longitudinal axis 110. Portions of fluid flow passageway 104 adjacent to inlet 106 may include a generally circular cross section approximately equal with the diameter of inlet 106. The cross section of fluid flow passageway 104 will generally decrease along the length of longitudinal axis 110. Outlet 108 may be formed in extreme end 126 of outlet section 120. Outlet 108 may have a modified slot configuration with an effective flow area generally equivalent to the area of a circle having a diameter of approximately 13/32 of an inch. Additional details concerning fluid flow passageway 104 and outlet section 120 will be discussed with respect to FIGS. 14A-14C.

Figure 5:
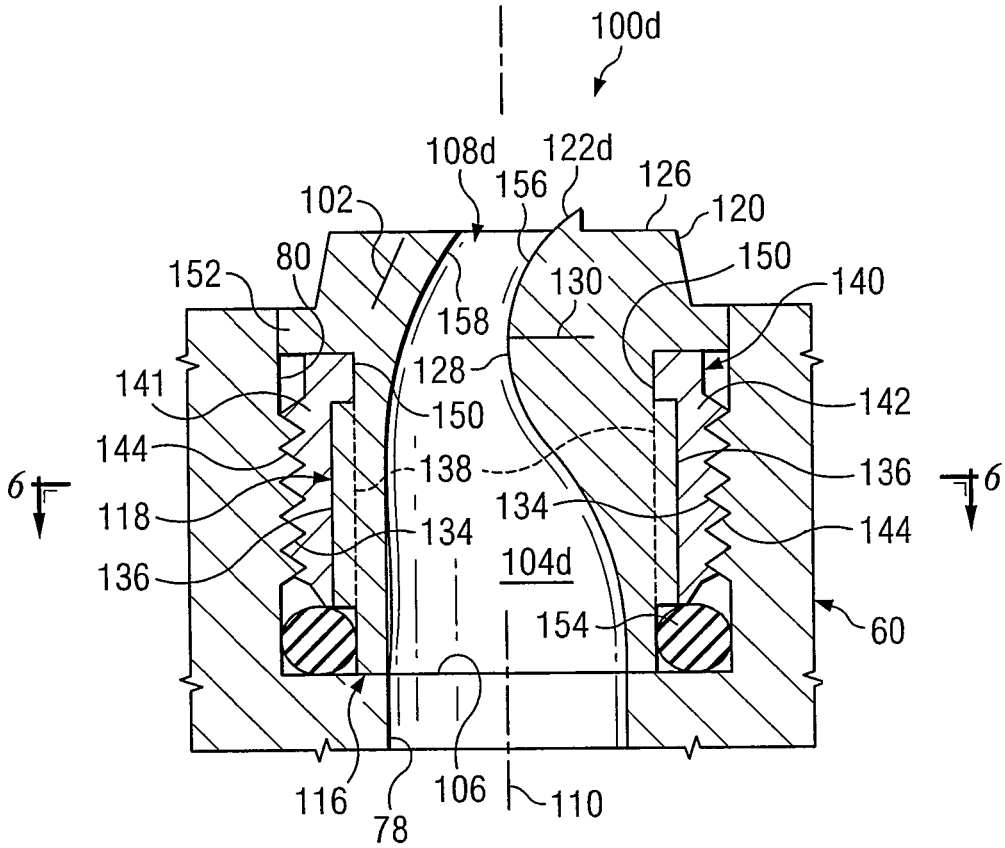
FIG. 5 is a schematic drawing in section with portions broken away showing another example of a nozzle disposed in a rotary drill bit incorporating teachings of the present disclosure.
Figure 6:
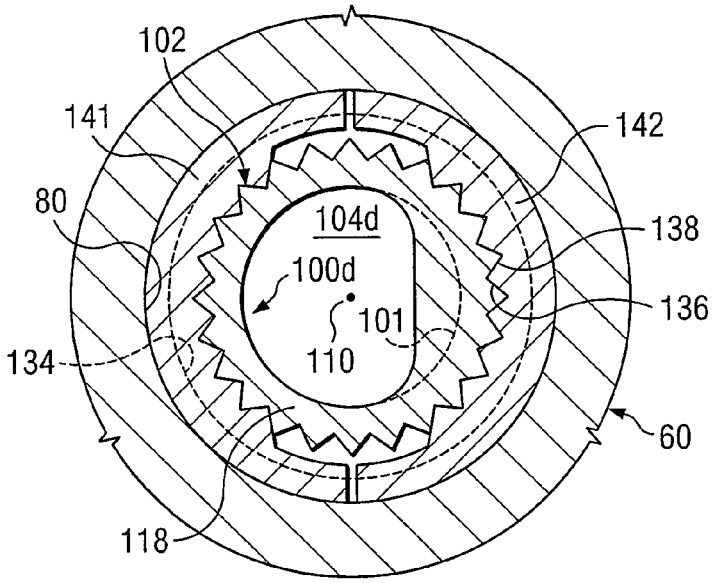
FIG. 6 is a schematic drawing in section with portions broken away taken along lines 6-6 of FIG. 5.
Figure 7:
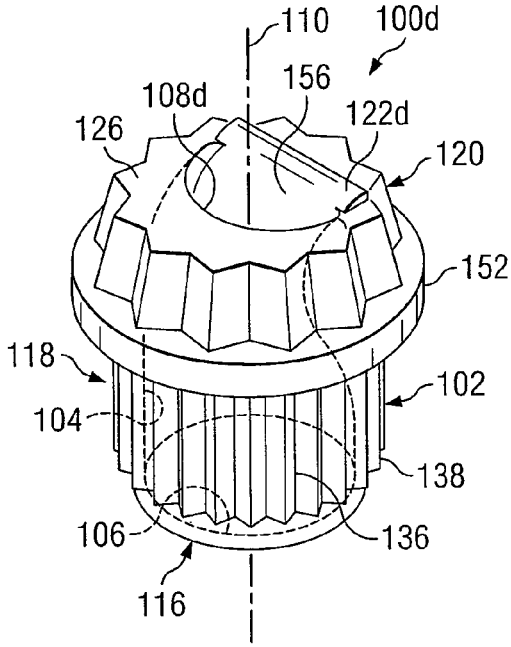
FIG. 7 is a schematic drawing showing an isometric view of a nozzle such as shown in FIG. 5.

Nozzle 100*d* is shown in FIGS. 5 and 6 disposed within nozzle housing 80 of bit body 60. Threaded collar 140 may be used to position nozzle 100*d* in nozzle housing 80 with a desired orientation for a fluid stream exiting therefrom. Threaded collar 140 may include a pair of cylindrical segments 141 and 142 which surround middle portion 118. Cylindrical segments 141 and 142 may also be described as "sleeve halves". Sleeve segments 141 and 142 may be formed from various metal alloys compatible with nozzle body 102 and bit body 60.

Sleeve segments 141 and 142 may include respective grooves 146 and ridges 148 extending longitudinally along interior portions of each sleeve segment 141 and 142. Grooves 146 and 148 have dimensions and configurations compatible with corresponding grooves 136 and ridges 138 formed on the exterior of nozzle body 102. Engagement of grooves 136 with respective ridges 148 of sleeve segments 141 and 142 and grooves 146 with respective ridges 138 formed on middle portion 118 of nozzle body 102 may provide a mechanical interlock or interference fit that prevents nozzle body 102 from rotating relative to the sleeve segments 141 and 142 when assembled in bit body 60.

Exterior portions of sleeve segments 141 and 142 may include threads 144 which are designed to engage corresponding threads 134 formed on interior portions of each opening or receptacle 80. One end of each sleeve segment 141 and 142 preferably includes respective flange or lip 150 sized to be received within an annular groove or recess formed between annular ring 152 and respective longitudinal grooves 136 and ridges 138. Flanges or lips 150 prevent longitudinal movement of nozzle body 102 relative to receptacle 80 when threads 144 of sleeve segments 141 and 142 are engaged with threads 134 of respective receptacle 180.

For some applications, elastomeric seal 154 as shown in FIG. 5 may be disposed between exterior portions of nozzle body 102 and adjacent portions of receptacle 80. Elastomeric seal 154 may form a fluid tight barrier between exterior surfaces of nozzle body 102 and interior surfaces of receptacle 80. Elastomeric seal 154 may prevent drilling fluids from entering into an annular area formed between nozzle body 102 and adjacent portions of receptacle 80 to protect threads 134 and 144 from possible erosion caused by the flow of drilling fluids therethrough.

Nozzle 100*d* may include nozzle body 102 as previously described with respect to nozzle 100. Nozzle 100*d* may include outlet 108*d* formed in extreme end 126 of outlet portion 120. Outlet portion 108 may have a modified semicircular configuration or modified "D-shaped" configuration with an effective flow area generally equivalent to the area of a circle having a diameter of approximately 13/32 of an inch.

Fluid flow passageway 104*d* may extend between inlet 106 and outlet 108*d*. Fluid flow passageway 104*d* may have a complex, variable geometry relative to longitudinal axis 110. Portions of longitudinal passageway 104*d* disposed adjacent to inlet 106 may include a generally circular cross section corresponding approximately with the generally circular cross section of inlet 106. The cross section of fluid flow passageway 104*d* will generally decrease along the length of longitudinal axis 110. Additional details concerning fluid flow passageway 104*d* and outlet 106*d* will be discussed with respect to FIGS. 15A-15C.

Figure 8:
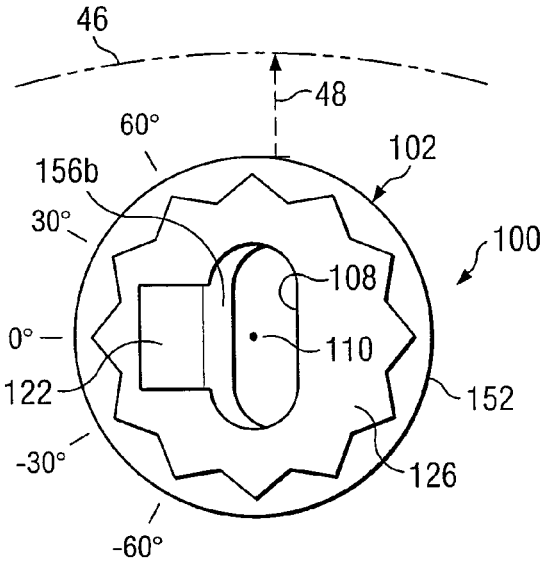
FIG. 8 is a schematic drawing showing one example of determining orientation or angular direction of a fluid stream exiting from a nozzle incorporating teachings of the present disclosure.
Figure 9:
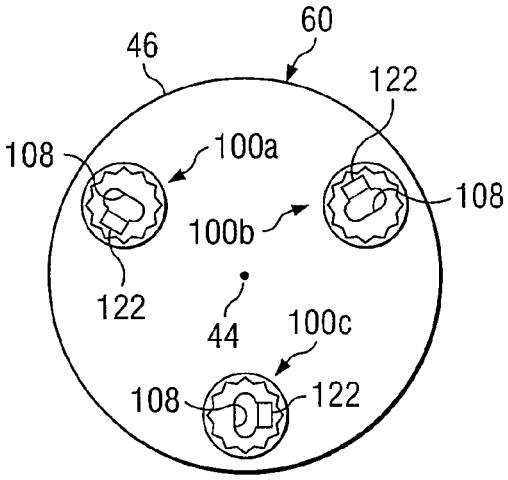
FIG. 9 is a schematic drawing in section with portions broken away showing nozzles disposed in a bit body with each nozzle having an outlet oriented to direct a fluid stream exiting therefrom at an angle of approximately zero (0°) degrees in accordance with teachings of the present disclosure.
Figure 10:
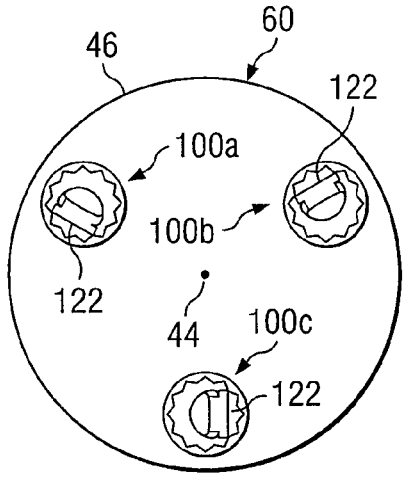
FIG. 10 is a schematic drawing in section with portions broken away showing nozzles disposed in a bit body with each nozzle having a receptive outlet oriented to direct a fluid stream exiting therefrom at an angle selected in accordance with teachings of the present disclosure.

FIGS. 8, 9 and 10 are representative of one method and/or technique which may be satisfactorily used to define the position of nozzles and fluid streams exiting therefrom in accordance with teachings of the present disclosure. For purposes of illustrating various features of the present disclosure bit body 60 is shown in FIGS. 8, 9 and 10 as having a generally circular configuration. However, exterior portions of a rotary drill bit may have various configurations other than circular.

Nozzles 100 as shown in FIGS. 9 and 10 have been designated as 100*a*, 100*b* and 100*c*. However, nozzles 100*a*, 100*b* and 100*c* may have substantially the same overall configuration and dimensions. Various testing and visualization may be conducted for a rotary drill bit to indicate an optimum orientation of each nozzle relative to associated cutting structures and adjacent portions of a wellbore using teachings of the present disclosure.

Nozzles 100*a*, 100*b* and 100*c* may be located approximately equal distance from each other around the perimeter of bit body 60 and also relative to bit rotational axis 44. For example each nozzle 100*a*, 100*b* and 100*c* may be located on a radius extending from rotational axis 44. An optimum orientation and location for nozzles 100*a*, 100*b* and 100*c* relative to bit body 60 may be defined with respect to bit rotational axis 44.

Cooperation between grooves 136 and flanges 138 formed on the exterior of nozzle body 102 and grooves 146 and ridges 148 formed on the interior of sleeve segments or collar segments 141 and 142 allow placing each nozzle body 102 in twenty-four different positions. Therefore, nozzle body 102 may be used to direct a fluid streams exiting therefrom in twenty-four different directions or orientations relative to associated cutting structures and/or adjacent portions of a wellbore.

For purposes of describing various features of the present disclosure, each nozzle may be described as having a "zero position". For embodiments such as shown in FIGS. 8, 9 and 10, the "zero position" for nozzles 100*a*, 100*b* and 100*c* may correspond with Coanda surface 122 being oriented generally perpendicular with respect to a radius extending from rotational axis 44 of bit body 60 to outside diameter 46 of bit body 60. The zero nozzle position may sometimes correspond with fluid exiting a nozzle pointed directly at an associated roller cone gage row.

As shown in FIG. 8 a positive nozzle position means nozzle 100 was rotated towards an associated sidewall from the zero position. A negative nozzle position means nozzle 100 was rotated towards bit rotational axis 44 from the zero position. Arrow 48 which represents portions of a radius extending from bit rotational axis 44 and outside diameter 46 are shown in dotted lines on FIG. 8. Nozzles 100*a*, 100*b* and 100*c* are shown in respective zero positions in FIG. 9.

Swirl performance may be enhanced or reduced based on orientation of a nozzle or rotation from an associated zero position. Testing in a drill bit simulator evaluated overall performance of nozzles 100 installed in a standard 12¼ inch roller cone drill bit. The tests indicated that large swirl angles may be obtained using an orientation of plus thirty (+30°) degrees for each nozzle. Rotating each nozzle 100 clockwise to plus thirty (+30°) degrees produced a flow field with a maximum swirl angle of approximately thirty-three (33°) degrees. The swirl angle may sometimes be referred to as "angle alpha." As part of orientation optimization, one additional constraint may be imposed that the jet stream exiting from each nozzle 100 not impinge upon adjacent cutting structures of the test drill bit.

Thirty (+30°) degrees nozzle orientation for some rotary drill bits may result in a highly structured flow field. Fluid flow within the annulus maintained desired angular orientation for considerable distance away from the test drill bit. The organized flow field more efficiently uses available energy from drilling fluid injected through nozzles 100 while simultaneously eliminating large scale re-circulation zones that often dominate in a well annulus when using many conventional nozzles.

For other applications an optimum orientation to produce desired swirling flow in a well annulus may be nozzle 100*a* with an orientation of sixty (60°) degrees, nozzle 100*b* with an orientation of forty-five (45°) degrees and nozzle 100*c* with an orientation of sixty (60°) degrees. However, the optimum orientation of each nozzle may vary depending upon configuration and dimensions of an associated rotary drill bit and anticipated down hole drilling conditions.

Optimizing the orientation of nozzles 100, 100*d*, 200 and/or 300 may enhance removal of formation cuttings from the end or bottom of a wellbore to the associated well surface. The optimum orientation of a fluid stream exiting from each nozzle 100, 100*d*, 200 and 300 may be selected to produce a strong swirling motion of drilling fluid and formation cuttings around the exterior of an associated rotary drill bit and adjacent portions of an associated well annulus.

Various teachings of the present disclosure may be used to design conventional nozzles or any other nozzle associated with rotary drill bits to include one or more Coanda surfaces for use in optimizing fluid flow and directing fluid flow therefrom. FIGS. 11 and 12 show examples of nozzles which may be modified to include a Coanda surface formed on an outlet portion of the associated nozzle. The interior configuration and design of nozzles 200 and 300 as shown in FIGS. 11 and 12 has not been changed from an existing design. For some applications a nozzle associated with a specific rotary drill bit design may be modified or redesigned in accordance with teachings of the present disclosure to direct fluid streams at a desired deflection angle based on anticipated downhole drilling conditions. Other components of the rotary drill bit such as forging for associated support arms or molds for an associated matrix bit body may continue to be used without requiring any change to obtain the desired fluid stream deflection angle FIG. 11 shows nozzle 200 having at least one Coanda surface formed in accordance with teachings of the present disclosure. Nozzle 200 may be satisfactorily used with a wide variety of rotary drill bits including, but not limited to, rotary drill bit 40 and rotary drill bit 240.

Nozzle 200 may include nozzle body 202 with fluid flow passageway 204 extending therethrough. Nozzle body 202 may include inlet portion 216 having inlet 106 disposed therein and outlet portion 220 with outlet 208 formed therein. Fluid flow passageway 204 may extend between inlet 106 and outlet 208. Outlet 208 may have a similar configuration and dimensions as previously described with respect to outlet 108.

Nozzle body 202 may be described as having a generally hollow, cylindrical configuration defined in part by inlet portion or inlet section 216, middle section 218 and outlet portion 220. Nozzle 200 may also include longitudinal axis or longitudinal center line 210 extending from the center of inlet 106 through nozzle body 202. Various features and characteristics of nozzle 200 may be described with respect to longitudinal axis 210. Nozzle body 202 may include previously described annular ring or flange 152.

Fluid flow passageway 204 may have a generally tapered, conical configuration extending between inlet 106 and outlet 308. The dimensions and configuration of fluid flow passageway 204 may be generally symmetrical relative to longitudinal axis 210. As previously noted, a nozzle having one or more Coanda surfaces incorporating teachings of the present disclosure may have a wide variety of inlet, outlet and fluid flow passageway configurations and dimensions.

For some applications outlet portion 220 of nozzle 200 may include Coanda surface 222 formed adjacent to outlet 208. The dimensions and configuration of Coanda surface 222 may be approximately the same as Coanda surface 122 on nozzle 100. One of the benefits of forming a nozzle and nozzle body such as shown in FIG. 11 includes the ability to change the deflection angle of a fluid stream exiting from outlet 208 without having to modify the dimensions and/or configurations associated with inlet 106, outlet 208 and/or fluid flow passageway 204.

FIG. 12 shows another example of a nozzle having at least one Coanda surface formed in accordance with teachings of the present disclosure. Nozzle 300 as shown in FIG. 12 may be satisfactorily used with a wide variety of rotary drill bits including, but not limited to, rotary drill bit 40 and rotary drill bit 240.

Nozzle body 302 may be described as having a generally hollow, cylindrical configuration defined in part by inlet portion or inlet section 316, outlet portion or outlet section 320 and middle section or middle portion 318. Outlet portion 320 may include extreme end 326 with outlet 308 formed therein. Nozzle 300 may also include longitudinal axis or longitudinal center line 310 extending from the center of inlet 306 through nozzle body 302. Various features and characteristics of nozzle 300 may be described with respect to longitudinal axis 310. For some applications inlet 106 may have a generally circular configuration with a diameter of approximately 1.250 inches. Outlet 308 may also have a generally circular configuration with a diameter of approximately 16/32 of an inch.

Fluid flow passageway 304 may have a generally tapered, conical configuration extending between inlet 106 and outlet 308. The dimension and configuration of fluid flow passageway 304 may be generally symmetrical relative to longitudinal axis 310. As previously noted, a nozzle having one or more Coanda surfaces incorporating teachings of the present disclosure may have a wide variety of inlet, outlet and fluid flow passageway configurations and dimensions.

For some applications outlet portion 320 of nozzle 300 may include Coanda surface 322 formed adjacent to outlet 308. Various techniques may be satisfactorily used to form Coanda surface 322. For example, outlet portion 320 may be satisfactorily machined with radius 324 extending from extreme end 326 of outlet portion 320. For other applications various welding techniques may be satisfactorily used to form radius portion 324 on extreme end 326 of outlet portion 320.

For embodiments such as shown in FIG. 12 radius portion 324 may cover approximately one-half or approximately one hundred eighty (180°) degrees of the outlet 308. For other applications radius portion 324 may cover one hundred twenty (120°) degrees or sixty (60°) degrees of outlet 308. Also, radius portion 324 may be offset approximately 0.1 inches from the perimeter or edge of outlet 308. The design configuration and dimensions of Coanda surface of 322 may be varied to obtain the desired deflection angle, number of fluid flow streams or jets of drill fluid exiting from nozzle 300. One of the benefits of forming a nozzle and nozzle body such as shown in FIG. 12 includes the ability to change the deflection angle or jet angle without modifying the dimensions associated with inlet 306, outlet 308 or fluid flow passageway 304.

FIGS. 13A and 13B show examples of flow stream testing conducted with respect to nozzles 100 and 100*d*. Nozzle 100 was designed to have a mean jet stream deflection angle of approximately seven (7°) degrees. Nozzle 100*d* was designed to have a mean jet stream deflection angle of approximately forty-five (45°) degrees. Lab scale testing in a water tank indicated that one embodiment of nozzle 100 had a mean jet stream deflection angle of approximately nine and four tenths (9.4°) degrees. One embodiment of nozzle 100*d* had a mean jet stream deflection angle of approximately thirty-nine (39°) degrees. Such variations may have resulted in part from changes made to the nozzles to accommodate an available test facility. For some tests a nozzle with an inlet diameter of approximately 0.7 inches may have been used.

Nozzles 100 and 100*d* were tested with various flow rates. The results of such testings indicated that jet stream deflection angles remained relatively constant for relatively wide variations in fluid flow rate through both nozzles 100 and 100*d*. The results also indicated that Coanda surfaces associated with nozzles 100 and 100*d* cooperated with each other to maintain relatively constant spray angles.

For purposes of illustrating various features of the present disclosure reference line 110*a* is shown in FIGS. 13A and 13B substantially parallel with and offset from associated longitudinal axis 110 to avoid confusion with representations of spray patterns exiting from nozzles 100 and 100*d*. Velocity profiles were measured for respective fluid flow streams exiting from respective nozzles 100 and 100*d*. Portions of each flow stream 90 and 90*a* having the highest mean velocity are represented by dotted lines 92 and 92*a* in FIGS. 13A and 13B. Fluid streams 90 and 90*a* exiting from nozzles 90 and 90*a* are shown in FIGS. 13A and 13B in a vertical plane extending through reference line 110*a* and highest mean velocity axis 92 and 92*a*.

The angular relationship of highest velocity axis relative to reference line 110*a* may be defined as the deflection angle or the deviation angle for a fluid stream exiting from an associated nozzle. The spray angle, dispersion angle or spreading pattern associated with a fluid stream exiting from nozzle 100 and 100*d* may be defined as the sixth (6th) velocity layer relative to the highest mean velocity axis. For some applications, a spray angle may be relatively symmetrical with respect to the highest mean velocity axis. For other applications a fluid stream exiting from a nozzle may have a non-symmetrical configuration relative to the highest mean velocity axis.

The sixth velocity profile for fluid flow stream 90 is represented by lines 94 and 96. The sixth velocity profile of flow stream 90*a* is indicated by lines 94*a* and 96*a*. The spread of fluid stream 90 may be approximately four (4°) and five (5°) degrees from highest velocity axis 92 for a total spread of approximately eight (8°) to ten (10°) degrees. The spread of fluid stream 90*a* may be approximately four (4°) and five (5°) from highest velocity axis 92*a* for a total spread of approximately eight (8°) to ten (10°).

Each jet stream 90 and 90*a* may have a generally elliptical, oval or circular shaped cross section in a plane (not expressly shown) perpendicular to highest velocity axis 92 and 92*a*. The dimensions and/or configurations of such cross sections of flow stream 90 and 90*a* may expand as the distance increases from respective outlet portion 120 and 120*d*.

For some tests, the fluid flow rate through nozzles 100 and 100*d* was varied from approximately 37.5 gallons per minute to approximately one hundred gallons per minute. The following chart shows examples of variation in jet stream deflection angle and spray angle based upon changes in fluid flow rate through nozzle 100*d*.

| Flow rate (gpm) | Deflection angle (degree) | Spray angle (degree) |
|---|---|---|
| 37.5 | 43.65 | 19.61 |
| 67.5 | 44.62 | 19.5 |
| 100 | 44.84 | 19.31 |

The deflection angle for each nozzle may be varied depending upon the size and/or design of an associated rotary drill bit. For example, a roller cone drill bit having a nominal diameter of 12¼ inches may require a deflection angle of approximately seven (7°) degrees for drilling fluid flow exiting from associated nozzles 100 without directly contacting or impinging on cutting structures of adjacent roller cone assemblies. For some fixed cutter drill bits associated nozzles having a deflection angle of approximately forty-five (45°) may be appropriate to accommodate directing drilling fluid flow exiting from nozzles 100*d* to flow in a junk slot between adjacent blades without directly contacting or impinging associated cutting structures.

Figure 14A:
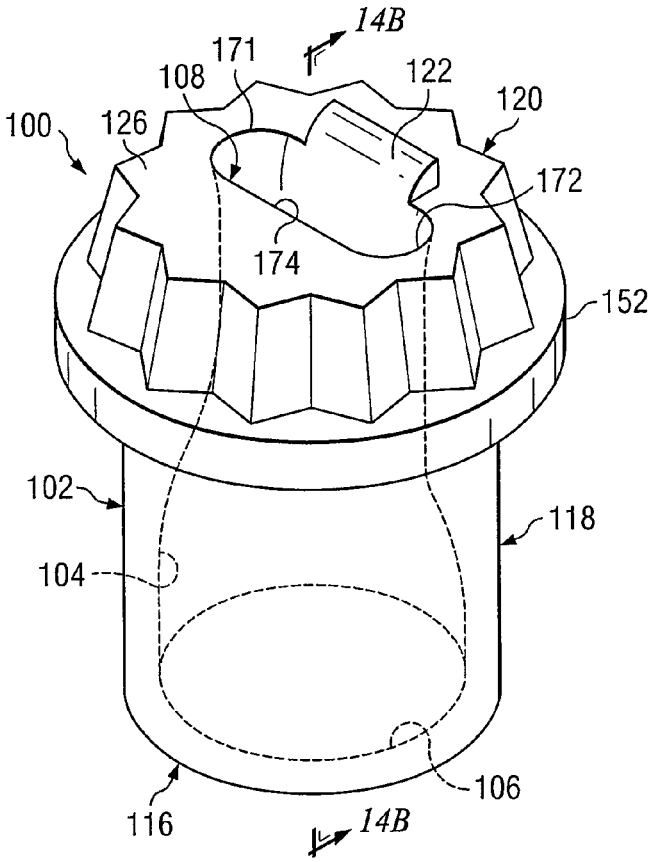
FIG. 14A is a schematic drawing in section with portions broken away showing one example of a nozzle having Coanda surfaces incorporating teachings of the present disclosure.
Figure 14C:
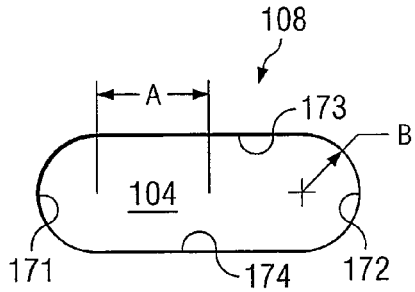
FIG. 14C is a schematic drawing showing a plan view of an outlet associated with the nozzle of FIG. 14A.
Figure 14B:
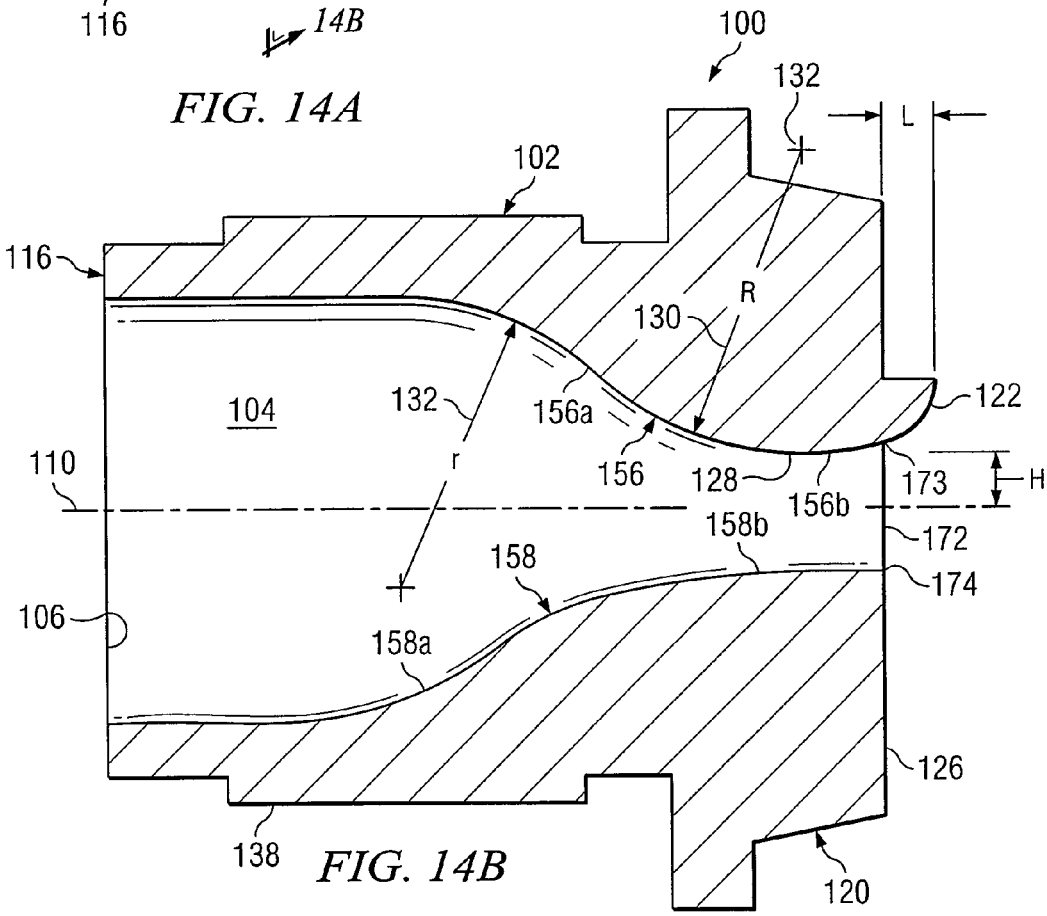
FIG. 14B is a schematic drawing in section taken along lines 14B-14B of FIG. 14A.
Figure 15A:
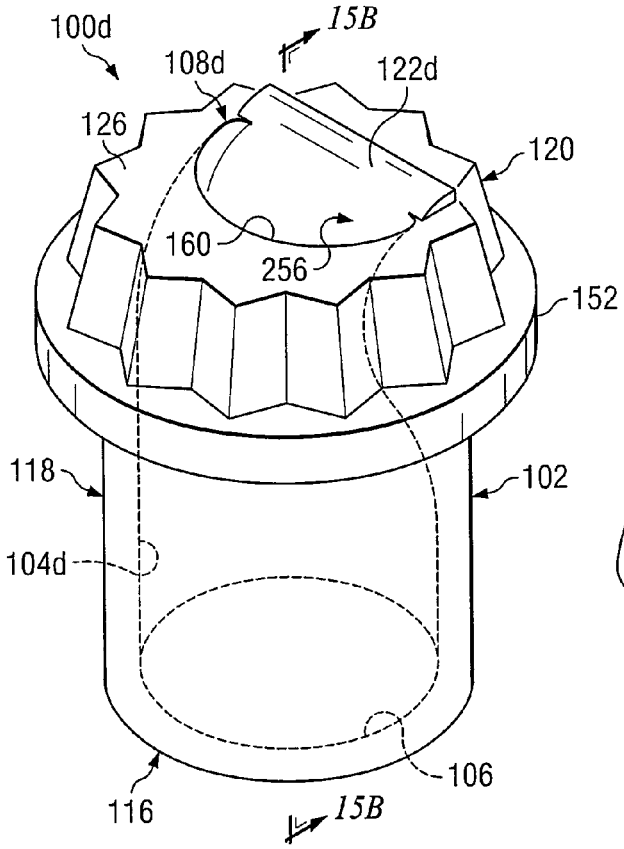
FIG. 15A is a schematic drawing in section with portions broken away showing another example of a nozzle having Coanda surfaces incorporating teachings of the present disclosure.
Figure 15C:
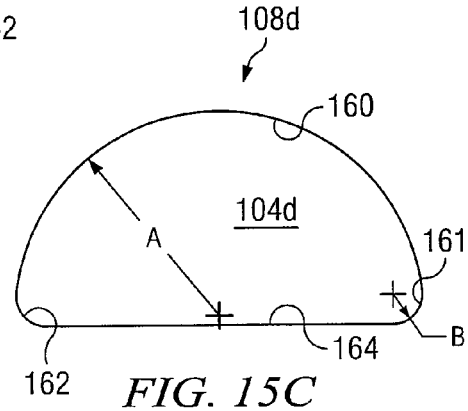
FIG. 15C is a schematic drawing showing a plan view of an outlet associated with the nozzle of FIG. 15A.

Various details associated with designing rotary drill bits, nozzles and/or Coanda surfaces in accordance with teachings of the present disclosure will be described with respect to nozzle 100 as shown in FIGS. 14A-14C and nozzle 100*d* as shown in FIGS. 15A and 15C. Reference may be made to various dimensions and configurations associated with inlets, outlets, Coanda surfaces and fluid flow streams associated with nozzles 100 and 100*d*. However, a wide variety of other dimensions and/or configurations may be satisfactorily used in the design of other rotary drill bits, nozzles and/or Coanda surfaces incorporated in the teachings of the present disclosure.

For embodiments such as shown in FIGS. 14A-14C, fluid flow passageway 104 may have a generally circular cross section adjacent to inlet 106 and a generally oval shaped or elliptical shaped cross section adjacent to outlet 108. The cross section of fluid flow passageway 104 will generally decrease along the length of longitudinal axis 110 to a position proximate reduced diameter portion 228 defined in part by radius 130.

One or more Coanda surfaces may be formed as part of fluid flow passageway 104. The dimensions and configuration of such Coanda surfaces may be selected to produce a desired Coanda effect as drilling fluid or other fluids flow through passageway 104 and exit from outlet 108. For example, Coanda surface 156 may be formed on interior portions of passageway 104 between inlet 106 and outlet 108. Coanda surface 156 may be based on a fifth order polynomial interpreted profile. One example of a fifth order polynomial will be discussed later with respect to the results of simulation conducted for nozzles 100 and 100*d*.

Coanda surface 156 may be generally described as having converging portion 156*a* and diverging portion 156*b* relative to longitudinal axis 110. Converging portion 156*a* may be defined in part by radius 132 and 130 as shown in FIG. 14B. Diverging portion 156*b* may be defined in part by radius 130. Reduced diameter portion 228 may be located proximate the transition between converging portion 156*a* and diverging portion 156*b*.

For some applications, generally converging surface 158 may be formed within fluid flow passageway 104 opposite from Coanda surface 156. Converging surface 158 may include generally arcuate or curved portion 158*a* and generally planar portion 158*b*. Converging surface 158 may cooperate with Coanda surface 156 to assist with forming a more coherent, relatively narrow jet stream or fluid stream exiting from outlet 108.

The configuration of outlet or discharge port 108 may be selected to assist in forming a coherent jet stream or fluid stream exiting from nozzle 100. For embodiments such as shown in FIGS. 14A-14C outlet 108 may be generally described as a modified slot defined in part by generally semi-circular end portions 171 and 172. For some embodiments ends 171 and 172 may be described as one-half of a circle. The diameter of each circle may be approximately 0.3 inches for some embodiments. End portions 171 and 172 may be formed with radius B as shown in FIG. 14C.

A pair of parallel lines or edges 173 and 174 may be used to join ends 171 and 172. The length of lines or edges 173 and 174 may be represented by dimension A extending from the middle of outlet 108 to the respective center for each radius B associated with ends 171 and 172. Coanda surface 156*b* may terminate with line 173 and adjacent portions of ends 171 and 172 or may continue as part of an associated Coanda ramp.

Surface 158*b* may terminate with line or edge 174 and adjacent portions of ends 171 and 172 of outlet 108. For some applications surface 156*b* may be disposed at an angle of approximately seven (7°) degrees relative to surface 158*b* adjacent to outlet 108.

Outlet portion 120 may also include Coanda surface 122 formed adjacent to and extending from Coanda surface 156. Coanda surface 122 may also be referred to as a "Coanda ramp." For some applications Coanda surface 122 may have dimensions corresponding with Coanda surface 156 formed by radius 130. For such applications, Coanda surface 122 may be generally described as a segment or a portion of a cylinder defined in part by radius 130 disposed upon or imbedded adjacent to edge 173 of outlet 108. For other applications, Coanda surface 122 may have different dimensions and/or different orientations relative to longitudinal axis 110 and outlet 108.

The dimensions and configuration of nozzle body 102 including passageway 104 may remain relatively constant but the direction (deflection angle) of drilling fluid exiting from outlet 108 may be changed by changing the angle and other dimensions associated with Coanda surface 122. The dimensions associated with Coanda surfaces 156 and 122 may be varied to produce a coherent jet stream or fluid stream exiting from nozzle 100 at a wide variety of dispersion angles other than approximately seven (7°) degrees relative to longitudinal axis 110.

The combined Coanda effect associated with drilling fluid contacting Coanda surface 156 and Coanda surface 122 may produce a strong bending of a jet stream or fluid stream exiting from outlet 108 in the direction of center point 132 of radius 130. As a result a fluid stream exiting from outlet 108 may form a spiraling flow path such as shown in FIGS. 2A and 3A for optimum removal of cuttings, maximum sweep over well bottom, minimum direct fluid impact on associated cutting structures and a high discharge coefficient.

For some applications, portions of surface 158*b* disposed adjacent to edge 174 of outlet 108 may diverge at an angle (not expressly shown) relative to longitudinal axis 110. Forming a diverging angle in surface 158*b* immediately adjacent to edge 174 may result in a fluid stream separating from surface 158*b* as the fluid stream exits outlet 108. As a result, the fluid stream may more closely contact or more closely follow Coanda surface 122. Forming a diverging surface immediately adjacent to edge 174 may result in stronger deflection of a fluid stream towards center point 132 as the fluid stream exits from outlet 108. For one embodiment a diverging surface with an angle of approximately seventeen (17°) degrees may be provided adjacent to edge 174.

The dimensions and configuration of Coanda surfaces 156 and/or 122 may be modified to provide a desired divergent angle which prevents erosion of adjacent cutting elements and cutting structures while producing strong swirling motion around exterior portions of drill string, large hydraulic shear stresses on bottom hole and substantial reduction or elimination of stagnation lines between cutting structures and associated rotary drill bits and adjacent portions of a wellbore. The dimensions and configuration of converging surface 158 and possibly an associated diverging surface may be selected to assist with deflection of the drilling fluid jet stream exiting from outlet 108.

Examples of dimensions for nozzle 100 as shown in FIGS. 14A-14C based on two dimensional and three dimensional simulations using a fifth order polynomial.

| R | r | H | L | A | B | beta (degree) | alpha (degree) |
|---|---|---|---|---|---|---|---|
| 0.6 | 0.43 | 0.06 | 0.08 | 0.18 | 0.15 | 5 | 28.1 |
| 0.5 | 0.43 | 0.06 | 0.08 | 0.18 | 0.15 | 5 | 26.1 |
| 0.6 | 0.43 | 0.08 | 0.08 | 0.18 | 0.15 | 5 | 25.7 |
| 0.6 | 0.43 | 0.06 | 0.12 | 0.18 | 0.15 | 5 | 31.9 |
| 0.7 | 0.43 | 0.06 | 0.12 | 0.18 | 0.15 | 5 | 31.6 |
| 0.6 | 0.43 | 0.06 | 0.14 | 0.18 | 0.15 | 5 | 29.7 |
| 0.6 | 0.43 | 0.04 | 0.12 | 0.18 | 0.15 | 5 | 33.8 |
| 0.6 | 0.43 | 0.04 | 0.12 | 0.18 | 0.09 | 5 | 37.0 |
| 0.6 | 0.43 | 0.06 | 0.12 | 0.14 | 0.09 | 5 | 14.7 |
| 0.6 | 0.43 | 0.06 | 0.12 | 0.14 | 0.09 | 5 | 32.9 |
| 0.6 | 0.43 | 0.04 | 0.12 | 0.15 | 0.09 | 5 | 16.9 |

For embodiments such as shown in FIGS. 15A and 15C fluid flow passageway 104 may have generally circular cross section adjacent to inlet 106 and a generally "D" shape or semi-circular shape adjacent to outlet 108*d*. The cross section of fluid flow passageway 104*d* will generally decrease along the length of longitudinal axis 110 to a position proximate reduced diameter portion 228*d* defined in part by radius 130*d*. One or more Coanda surfaces may be formed as part of fluid flow passageway 104. The dimensions and configuration of such Coanda surfaces may be selected to produce a desired Coanda effect as drilling fluid or other fluids flow through passageway 104*d* and exit from outlet 108*d*. For example, Coanda surface 256 may be formed on interior portions of passageway 108*d* between inlet 106 and outlet 108*d*. Coanda surface 256 may be based on a fifth order polynomial interpreted profile.

Figure 15B:
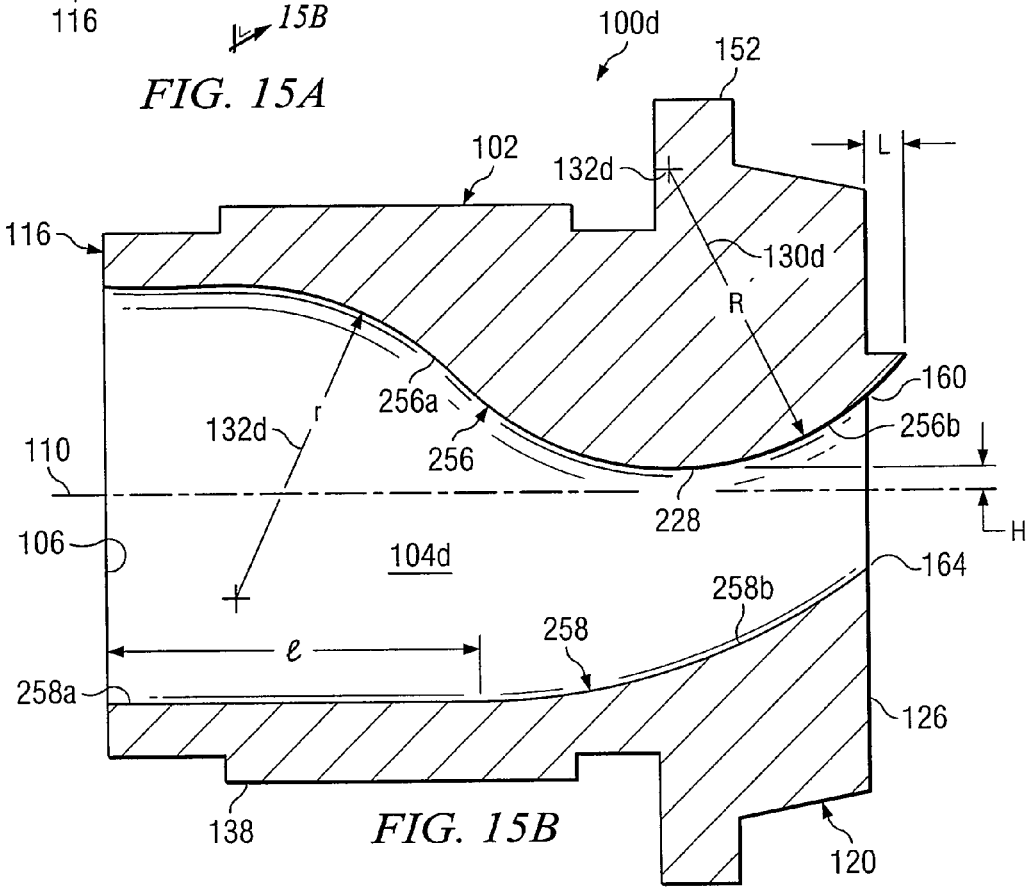
FIG. 15B is a schematic drawing in section taken along lines 15B-15B of FIG. 15A.

Coanda surface 256 may be generally described as having converging portion 256*a* and diverging portion 256*b* relative to longitudinal axis 110. Converging portion 256 a may be defined in part by radius 132*d* and radius 130*d* as shown in FIG. 15B. Diverging portion 256*b* may be defined in part by radius 130*d*. Reduced diameter portion 228 may be located proximate the transition between converging portion 256*a* and diverging portion 256*b*. For some applications a generally converging surface 258 may be formed within fluid flow passageway 104*d* opposite from Coanda surface 256. Converging surface 258 may include generally cylindrical portion 258*a* and a generally converging, arcuate portion 258*b*. Converging surface 258 may cooperate with Coanda 256 to assist with forming a more coherent, relatively narrow jet stream or fluid stream exiting from outlet 108*d*.

The configuration of outlet or discharge port 108*d* may be selected to assist in forming a coherent jet stream or flow stream of drilling fluid exiting from nozzle 100*d*. For embodiments such as shown in FIG. 15A-15C, outlet 108*d* may include circular segment 160 having a first end which terminates at radius 161 and a second end which terminates with radius 162. Generally straight line 164 may extend between first radius 161 and second radius 162. The configuration and dimensions associated with outlet 108 may be selected to assist in reducing the spread of a jet stream or a drilling fluid stream exiting therefrom.

Circular segment 160 may be formed by radius A as shown in FIG. 15C. Values for radius 161 and 162 are shown as B in the following chart. Outlet portion 120 of nozzle 104*d* may include Coanda surface 122*d* formed adjacent to and extending from Coanda surface 256. Coanda surface 122*d* may also be referred to as a "Coanda ramp." For some applications, Coanda surface 122*d* may have dimensions corresponding with Coanda surface 156 formed by radius 130*d*. For such applications, Coanda surface 122*d* may be generally described as a segment or a portion of a cylinder defined in part by radius 130*d* disposed upon or embedded in outlet portion 120 adjacent to outlet 108. For other applications, Coanda surface 122*d* may have different dimensions and/or different orientations relative to longitudinal axis 110 and outlet 108*d*.

The dimensions and configuration of nozzle body 102 including passageway 104*d* may remain relatively constant but the direction, "deflection angle" or drilling fluid exiting from outlet 108*b* may be changed by changing the angle and other dimensions associated with Coanda surface 122*d*. The dimensions associated with Coanda surfaces 256 and 122*d* may be varied to produce a coherent jet stream or fluid stream exiting from nozzle 100*d* at a wide variety of dispersion angles other than approximately 45 (45°) degrees relative to longitudinal axis 110.

The combined Coanda effect associated with drilling fluid contacting Coanda surface 256 and Coanda surface 122*d* may produce a strong bending of a jet stream or fluid stream exiting from outlet 108*d* in the direction of center 132*d* of radius 130*d*. As a result, a fluid stream exiting from outlet 108*d* may form a spiraling flow path for optimal removal of formation cuttings come a maximum sweep over a well bottom, minimum direct fluid impingement on associated cutting structures and a high discharge coefficient. Cooperation between Coanda surface 256 and converging surface 258 may eliminate any sharp edges or sharp turns within associated fluid flow passageway 104*d*. Converging surface 258 may be designed to subject substantially all of the fluid exiting from nozzle 100*d* to the Coanda effect associated with surface 256.

Examples of dimensions for nozzle 100*d* as shown in FIG. 15A-15C based on three dimensional simulations using a fifth order polynomial.

| R | r | H | L | A | B | l | alpha |
|---|---|---|---|---|---|---|---|
| 0.3 | 1.1 | 0.02 | 0.08 | 0.17 | 0.07 | 0.288 | 41.3 |
| 0.6 | 0.9 | 0.02 | 0.12 | 0.18 | 0.09 | 0.288 | 38.5 |
| 0.45 | 1.1 | 0.02 | 0.10 | 0.17 | 0.08 | 0.3 | 44.6 |

Design of Coanda Surfaces

The following equations are examples of a fifth ($5^{th}$) order polynomial which may be used to design an efficient low losses nozzle having a Coanda surface in accordance with teachings of the present disclosure. For a nozzle having an inlet defined by a radius r at x=0 and a nozzle length defined by x=L and exit radius R, an equation for designing a Coanda surface or nozzle contour may be:

$$y=ax^5+bx^4+cx^3+dx^2+ex+f$$

Six equations to solve for the six unknowns (a, b, c, d, e and f) are derived using the following requirements:

At x=0: y=r: so r=f 1)

At $x=L$: $y=R$: $R=aL^5+bL^4+cL^3+dL^2+eL+f$ 2)

At x=0 the first derivative $y'(0)=0$: $y'=5ax^4+4bx^3+3cx^2+2dx+e=0$, so $e=0$ 3)

At x=L the first derivative $y'(L)=0$: $5aL^4+4bL^3+3cL^2+2dL+e=0$ 4)

At x=0 the second derivative $y''(0)=0$: $y''=20ax^3+12bx^2+6cx+2d=0$, so $d=0$ 5)

At x=L the second derivative $y''(L)=0$: $y''=20aL^3+12bL^2+6cL+2d=0$ 6)

Now we have: f=r; e=0; d=0

Three equations for determining the values of the remaining three unknowns (a, b, c) are:

$$R=aL^5+bL^4+cL^3+r \quad 1)$$

$$0=5aL^4+4bL^3+3cL^2 \quad 2)$$

$$0=20aL^3+12bL^2+6cL \quad 3)$$

The condition that the first and second derivatives are zero at x=0 (nozzle's inlet) and x=L (nozzle's outlet) ensures that a resulting nozzle contour or Coanda surface is such that a fluid stream will enter and leave an associated nozzle generally parallel to its axis and will not have sharp turns that may induce separation from the nozzle contour or Coanda surface thereby reducing nozzle efficiency. Additional comments about the design of Coanda surfaces and fifth order polynomials may be found in Journal of Fluid Mechanics (1987) volume 179, pages 383-405 entitled "Vortex induction and mass entrainment in a small-aspect-ratio elliptic jet" by Chih-Ming Ho and Ephriam Gutmark.

Conventional nozzles primarily accelerate drilling fluid exiting therefrom to impart energy on adjacent portions of a downhole formation and may neglect to efficiently remove and transport any cuttings away from an associated rotary drill bit. Fluid exiting from conventional nozzles may produce high unstructured flow with large re-circulation zones, essentially wasting available energy needed to effectively clean, remove and transport formation cuttings and other downhole debris away from the rotary drill bit. Comparison of discharge coefficient of various nozzles may not adequately indicate overall downhole performance of each nozzle. Various tests and simulations indicated that nozzles incorporating teachings of the present disclosures may produce overall flow structures within a well annulus that foster effective removal of the formation cuttings while maintaining relatively high discharge coefficients. Such nozzles may also require reduced hydraulic horsepower from an associated drilling fluid pumping system.

Comparisons of discharge coefficients at various flow rates indicated the nozzles 100 and 100*d* are generally as efficient as many conventional, straight nozzles. The average reduction in efficiency may be for nozzles incorporating teachings of the present disclosure may be approximately 0.75% to 1.3%. Any penalty due to deflection of a jet stream exiting from nozzles 100 and 100*d* occurred only at higher flow rates. The average discharge coefficients with flow rates below fifty (50) gpm was approximately the same for nozzle 100, 100*d* and conventional, straight nozzles being tested. Obtaining a stable and organized swirling flow field to effectively clean, remove and transport the formation cuttings away from a drill bit with no performance loss may be very beneficial.

Discharge Coefficient Calculation

The discharge coefficient is a non-dimensional number, which characterizes the pressure loss through a nozzle. The discharge coefficient offers a means to compare the performance of nozzles.

For non-compressible fluid flow, the Bernoulli equation is:

$$P+\frac{1}{2}\rho V^2+\rho gZ=cst$$

Considering the flow going through the nozzle at stages 1 and 2, the equation becomes:

$$P_1 + \frac{1}{2}\rho V_1^2 + \rho g Z_1 = P_2 + \frac{1}{2}\rho V_2^2 + \rho g Z_2$$

For nozzle 100, $P_1$, $V_1$ and $Z_1$ are determined at inlet 106. $P_2$, $V_2$ and $Z_2$ are determined at outlet 108.

Neglecting the gravity effect ($Z_1=Z_2$), and considering the jet exiting at atmospheric pressure ($P_2=P_{atm}$), the equation becomes:

$$V_2 = \sqrt{V_1^2 + \frac{2(P_1 - P_2)}{\rho}} = \sqrt{V_1^2 + \frac{2\Delta P}{\rho}}$$

Considering non-compressible perfect fluid flow, the flow rate will remain constant through the nozzle and the theoretical flow rate (Qth) becomes a function of the area and velocity in a given section. At an associated outlet such as outlet 108, the equation becomes:

$$Q_{th} = A_2 V_2 = A_2\sqrt{V_1^2 + \frac{2\Delta P}{\rho}}$$

Taking into account pressure losses in the nozzle due to friction, real flow rate (Q) is generally lower than an associated theoretical flow rate. Then a discharge coefficient may be introduced to correct the equation:

$$Q=C_d \times Q_{th}$$

Thus the discharge coefficient may be written as:

$$C_d = \frac{Q}{A_2}\left[\sqrt{V_1^2 + \frac{2\Delta P}{\rho}}\right]^{-1} = 0.90$$

Although the present disclosure and its advantages have been described in detail, it should be understood that various changes, substitutions and alternations can be made herein without departing from the spirit and scope of the disclosure as defined by the following claims.

What is claimed is:

1. A rotary drill bit for forming a wellbore, comprising:

a bit body having an upper portion adapted for engagement with a drill string for rotation of the bit body;

a number of cutting structures engaged with the bit body a fluid cavity formed in the bit body and sized to receive drilling fluid from an attached drill string;

a plurality of fluid flow passageways extending from the cavity to respective nozzles engaged with exterior portions of the bit body;

each nozzle having a nozzle body with a fluid flow passageway extending between an inlet portion and an outlet portion of the nozzle body;

a first Coanda surface disposed within the fluid flow passageway adjacent the outlet portion;

the first Coanda surface configured to direct a fluid stream from the nozzle body in a desired direction; and a second Coanda surface disposed outside the fluid flow passageway adjacent to and extending from the first Coanda surface.

2. The rotary drill bit of claim 1 further comprising the first Coanda surface directing the fluid stream to minimize erosion and optimize cleaning of associated cutting structures.

3. The rotary drill bit of claim 1 further comprising the first Coanda surface directing the fluid stream to maximize removal of formation cuttings.

4. The rotary drill bit of claim 1 selected from the group consisting of a roller cone drill bit and a fixed cutter drill bit.

5. The rotary drill bit of claim 1 wherein the nozzle body further comprises:

an inlet formed in the inlet portion;

the inlet operable to receive drilling fluid from one of the drill fluid flow passageways extending from the cavity in the bit body;

an outlet formed in the outlet portion of the nozzle body;

the inlet portion having a first flow area and the outlet portion having a second flow area;

the first flow area of the inlet portion larger than the second flow area of the outlet portion;

the outlet portion having an extreme end with the first Coanda surface extending therefrom; and the first Coanda surface disposed adjacent to the outlet and extending partially along a perimeter of the outlet.

6. The rotary drill bit of claim 1 further comprising:

the outlet portion having an extreme end surface of the nozzle body;

an outlet formed in the extreme end of the nozzle body;

the outlet having a cross-section selected from the group consisting of circular, oval, elliptical, elongated slot, D-shaped or semi-circular; and the first Coanda surface disposed adjacent to the outlet and extending partially along a perimeter of the outlet.

7. The rotary drill bit of claim 1 further comprising:

the inlet portion of each nozzle having an inlet coupled with and operable to receive drilling fluid from the drilling fluid passageway extending from the cavity to the respective nozzle;

the outlet portion of each nozzle having an extreme end surface with an outlet formed therein;

a converging surface formed within each fluid passageway extending between the associated inlet portion and the associated outlet portion; and each converging surface cooperating with the associated first Coanda surface to assist in forming a coherent narrow fluid flow stream exiting from the outlet.

8. The rotary drill bit of claim 1 wherein each outlet portion comprises:

an outlet defined in part by a segment of a circle;

the segment of the circle having a first end and a second end;

a first radius formed at a first end of the segment of the circle;

a second radius formed at a second end of the segment of the circle; and a generally straight line extending from the first radius to the second radius.

9. A rotary drill bit operable to form a bore hole comprising:

a bit body having a plurality of cutting structures;

the cutting structures operable to engage adjacent portions of a downhole formation to form the bore hole in response to rotation of the rotary drill bit;

one end of the bit body having a threaded connection operable for engagement with a bottom hole assembly;

the rotary drill bit and the bottom hole assembly generally aligned with each other along a longitudinal axis during formation of a vertical bore hole;

a plurality of nozzles formed in the bit body and operable to direct fluid flow from a drill string attached to the rotary drill bit to exterior portions of the bit body;

at least one of the plurality of nozzles including a first Coanda surface disposed within the fluid flow passageway adjacent the outlet portion, the first Coanda surface configured to direct a fluid stream from the nozzle body in a desired direction, and a second Coanda surface disposed outside the fluid flow passageway adjacent to and extending from the first Coanda surface;

the nozzles cooperating with each other to create respective fluid flow streams in an annulus formed between exterior portions of rotary drill bit and the attached bottom hole assembly and adjacent interior portions of the bore hole; and the fluid flow streams moving at an angle of approximately twenty-eight (28°) degrees to thirty-eight (38°) degrees relative to the longitudinal axis.

10. The rotary drill bit of claim 9 further comprising each nozzle having at least one Coanda surface operable to direct a fluid stream exiting from the respective nozzle.

11. The rotary drill bit of claim 9 further comprising at least one of the nozzles having a first Coanda surface operable to direct fluid flow exiting from the respective nozzle at an angle between approximately zero (0°) degrees and one hundred eighty (180°) degrees relative to an outlet portion of the nozzle body.

12. The rotary drill bit of claim 9 further comprising each nozzle having at least one Coanda surface corresponding with a fifth order polynomial contraction.

13. A system operable to form a wellbore extending from a well surface through at least one downhole formation comprising:

a drill string having a bottom hole assembly attached with one end of a drill string;

a rotary drill bit attached with the bottom hole assembly opposite from the drill string whereby rotation of the drill string and bottom hole assembly results in rotation of the rotary drill bit;

a plurality of nozzles disposed in the bit body;

each nozzle having a first Coanda surface disposed within the fluid flow passageway adjacent the outlet portion, the first Coanda surface configured to direct a fluid stream from the nozzle body in a desired direction;

each nozzle having a second Coanda surface disposed outside the fluid flow passageway adjacent to and extending from the first Coanda surface; and the nozzles cooperating with each other to form respective swirling fluid flow paths on exterior portions of the rotary drill bit and the bottom hole assembly.

14. The system of claim 13 further comprising each nozzle directing fluid flow at an optimum angle to enhance cleaning of an associated cutting structure and to prevent balling of formation materials on the associated cutting structure.

15. The system of claim 13 further comprising each nozzle directing fluid flow to exit therefrom at an angle which optimizes shearing forces associated with fluid flow across a bottom of the wellbore.

16. The system of claim 13 further comprising each nozzle having an internal flow path with an optimized configuration based on computed fluid dynamics (CFD).

17. The system of claim 13 further comprising the fluid flow path exiting from at least one nozzle at an angle between approximately seven (7°) degrees relative to a longitudinal axis of the at least one nozzle and approximately forty-five (45°) degrees relative to the longitudinal axis of the at least one nozzle.

18. The system of claim 13 further comprising the fluid flow paths having a generally swirling configuration defined by approximately four wraps per foot along exterior portions of the bottom hole assembly.

19. The system of claim 13 further comprising the nozzles cooperating with each other to produce tightly controlled fluid spirals with approximately one inch of lift per ninety (90°) degrees of spiral relative to exterior portions of the drill bit and bottom hole assembly.

20. The system of claim 13 further comprising the nozzles cooperating with each other to produce tightly controlled fluid spirals with approximately four inches of lift per three hundred sixty (360°) degrees of spiral relative to exterior portions of the drill bit and bottom hole assembly.

21. A rotary drill bit for forming a wellbore, comprising:

a bit body having an upper portion adapted for engagement with a drill string for rotation of the bit body;

a number of cutting structures engaged with the bit body;

a fluid cavity formed in the bit body and sized to receive drilling fluid from an attached drill string;

a plurality of fluid flow passageways extending from the cavity to respective nozzles engaged with exterior portions of the bit body;

each nozzle having a nozzle body with a fluid flow passageway extending between an inlet portion and an outlet portion of the nozzle body;

a first Coanda surface disposed on and extending from the outlet portion;

the first Coanda surface operable to direct a fluid stream from the nozzle body in a desired direction the inlet portion of each nozzle having an inlet coupled with and operable to receive drilling fluid from the drilling fluid passageway extending from the cavity to the respective nozzle;

the outlet portion of each nozzle having an extreme end surface with an outlet formed therein;

a second Coanda surface formed within each fluid passageway extending between the associated inlet portion and the associated outlet portion;

each second Coanda surface cooperating with the associated first Coanda surface to assist in forming a coherent narrow fluid flow stream exiting from the outlet;

a converging surface formed within a portion of the respective fluid flow passageway at a location generally opposite from the respective second Coanda surface; and the converging surface cooperating with the respective second Coanda surface to enhance formation of a coherent fluid stream exiting from the associated outlet portion.

22. A rotary drill bit for forming a wellbore, comprising:

a bit body having an upper portion adapted for engagement with a drill string for rotation of the bit body;

a number of cutting structures engaged with the bit body;

a fluid cavity formed in the bit body and sized to receive drilling fluid from an attached drill string;

a plurality of fluid flow passageways extending from the cavity to respective nozzles engaged with exterior portions of the bit body;

each nozzle having a nozzle body with a fluid flow passageway extending between an inlet portion and an outlet portion of the nozzle body; and a first Coanda surface formed within each fluid passageway extending between the associated inlet portion and the associated outlet portion, the inlet portion of each nozzle having an inlet coupled with and operable to receive drilling fluid from the drilling fluid passageway extending from the cavity to the respective nozzle;

the outlet portion of each nozzle having an extreme end surface with an outlet formed therein;

a second Coanda surface disposed on and extending from the outlet portion;

the second Coanda surface operable to direct a fluid stream from the nozzle body in a desired direction; and each second Coanda surface cooperating with the associated first Coanda surface to assist in forming a coherent narrow fluid flow stream exiting from the outlet.

* * * * *

UNITED STATES PATENT AND TRADEMARK OFFICE

CERTIFICATE OF CORRECTION

PATENT NO. : 7,802,640 B2
APPLICATION NO. : 11/466252
DATED : September 28, 2010
INVENTOR(S) : Ephraim J. Gutmark et al.

It is certified that error appears in the above-identified patent and that said Letters Patent is hereby corrected as shown below:

Title page [75] Inventor: Please correct the residence of the Second Inventor, Tuck Leong Ho, by deleting "Fernwood Forest" and replacing with --Houston--

Signed and Sealed this
Seventeenth Day of May, 2011

David J. Kappos

David J. Kappos
*Director of the United States Patent and Trademark Office*